US008087547B1

(12) United States Patent
Lindsey

(10) Patent No.: US 8,087,547 B1
(45) Date of Patent: Jan. 3, 2012

(54) DISPENSING DEVICES WITH BOTTOM OUTLET FOR DISPENSING VISCOUS LIQUIDS

(76) Inventor: William J. Lindsey, Washburn, WI (US)

( * ) Notice: Subject to any disclaimer, the term of this patent is extended or adjusted under 35 U.S.C. 154(b) by 0 days.

(21) Appl. No.: 08/869,616

(22) Filed: Jun. 5, 1997

Related U.S. Application Data

(63) Continuation of application No. 08/297,707, filed on Aug. 29, 1994, now Pat. No. 5,667,107, which is a continuation-in-part of application No. 08/203,524, filed on Feb. 28, 1994, now abandoned, which is a continuation of application No. 07/728,204, filed on Jul. 10, 1991, now abandoned.

(51) Int. Cl.
*B67D 7/06* (2010.01)

(52) U.S. Cl. ..... 222/184; 222/1; 222/173; 222/185.1; 222/212; 222/213; 222/490; 222/494

(58) Field of Classification Search ..... 222/105, 222/179.5, 181.2, 181.3, 184, 470, 185.1, 222/107, 173, 490, 494, 556, 206–215, 1.186, 222/566–568; 239/533.13, 533.14, 602; 137/846, 849, 859
See application file for complete search history.

(56) References Cited

U.S. PATENT DOCUMENTS

| | | | | | |
|---|---|---|---|---|---|
| 1,590,636 | A | * | 6/1926 | McManus et al. | 222/105 |
| 2,078,149 | A | | 4/1937 | Lutz | |
| 2,125,784 | A | | 8/1938 | Higgins | |
| 2,275,185 | A | * | 3/1942 | Shinn, Jr. | 222/151 |
| 2,281,651 | A | | 5/1942 | Wolcott | |
| 2,363,474 | A | * | 11/1944 | Schlesinger | 222/179.5 |
| 2,800,259 | A | | 7/1957 | Wilson et al. | |
| 3,172,356 | A | * | 3/1965 | Vosburg | 101/125 |
| 3,191,806 | A | | 6/1965 | Schultz et al. | |
| 3,236,417 | A | | 2/1966 | Linton | |
| 3,342,379 | A | * | 9/1967 | Foley | 222/181 |
| 3,400,866 | A | * | 9/1968 | Fattori | 222/511 |
| 3,813,072 | A | * | 5/1974 | Moore | 248/313 |
| 3,866,803 | A | | 2/1975 | Kipfmueller | |
| 4,022,352 | A | | 5/1977 | Pehr | |
| 4,085,867 | A | | 4/1978 | Heller | |
| 4,201,491 | A | * | 5/1980 | Kohler | 401/264 |
| 4,269,330 | A | * | 5/1981 | Johnson | 222/386 |
| 4,365,728 | A | * | 12/1982 | Tokorozawa et al. | 222/209 |
| 4,420,101 | A | * | 12/1983 | O'Neill | 222/212 |
| 4,434,810 | A | * | 3/1984 | Atkinson | 137/493 |
| 4,470,521 | A | * | 9/1984 | Scammell | 222/107 |
| 4,487,342 | A | | 12/1984 | Shy | |
| 4,519,530 | A | * | 5/1985 | Schmidt | 222/494 |
| 4,625,898 | A | | 12/1986 | Hazard | |
| 4,678,102 | A | * | 7/1987 | Ryder | 222/181 |
| 4,723,671 | A | | 2/1988 | Mears | |
| 4,728,006 | A | * | 3/1988 | Drobish et al. | 222/181 |

(Continued)

FOREIGN PATENT DOCUMENTS

| | | |
|---|---|---|
| GB | 2098958 | 12/1982 |

(Continued)

*Primary Examiner* — Frederick C Nicolas

(57) ABSTRACT

The squeeze container is made of a flexible material and is configured to store and dispense viscous fluid. The squeeze container is fitted with an automatic dispensing nozzle which allows flow when the container is squeezed and cuts off flow when the squeezing forces are removed. A stand is associated with the squeeze container, designed to hold the container in the nozzle down position. The stand may serve as a cover to protect the material before dispensing. The container may have a refill aperture and cap as well as a suspension device incorporated therein.

266 Claims, 9 Drawing Sheets

U.S. PATENT DOCUMENTS 4,749,108 A 6/1988 Dornsbush et al.
4,969,581 A * 11/1990 Seifert et al. ..... 222/212
5,033,655 A * 7/1991 Brown ..... 222/212
5,065,966 A 11/1991 Hartke
5,115,950 A 5/1992 Rohr
5,118,012 A 6/1992 Miller
5,123,561 A 6/1992 Gross
5,271,531 A 12/1993 Rohr et al.
5,307,955 A 5/1994 Viegas
5,390,805 A 2/1995 Bilini et al.
5,667,107 A * 9/1997 Lindsey ..... 222/173

FOREIGN PATENT DOCUMENTS

GB 2254062 9/1992

* cited by examiner

DISPENSING DEVICES WITH BOTTOM OUTLET FOR DISPENSING VISCOUS LIQUIDS

This is a continuation of U.S. Ser. No. 08/297,707, filed Aug. 29, 1994, now U.S. Pat. No. 5,667,107, which is a continuation-in-part of U.S. Ser. No. 08/203,524, filed Feb. 28, 1994, now abandoned, which is a continuation of U.S. Ser. No. 07/728,204, filed Jul. 10, 1991, now abandoned.

FIELD OF THE INVENTION

This invention is particularly directed to squeeze containers with bottom outlets and is especially useful for containers which hold viscous food material such as catsup, mustard, honey, and viscous non-food materials, such as shampoos, lotions, gels, and creams. The squeeze container may be provided with a cover stand, a cap stand or a stand. This enables the squeeze container to be stored between uses in a nozzle down configuration on a horizontal surface.

BACKGROUND OF THE INVENTION

In table service, many foods are offered and provided in squeeze containers. These containers in general have an upper spout and are turned over to dispense the food. The viscosity of some food materials is such that they do not run easily to the spout. Examples of such viscous liquid foods are catsup, mustard, mayonnaise and honey. The result is that the user must shake the container in the inverted position and wait with the container in the inverted position so as to permit the viscous food material to reach the spout before squeezing. This takes time and is inconvenient in many cases. Additionally, a certain amount of the food material lies on and around the nozzle to make it unclean and unsanitary. Insects can find this food and are attracted to it. Many non-food viscous materials are also difficult to dispense from a "nozzle up" squeeze bottle. Such materials include shampoos, lotions, gels, creams and oils.

There is a need for cover stands, cap stands and stands so that squeeze bottles can be stored and used in a nozzle down configuration.

SUMMARY OF THE INVENTION

In order to aid in the understanding of this invention, it can be stated in essentially summary form that it is directed to cover stands, cap stands and stands particularly useful for squeeze containers with bottom outlets which contain viscous fluids so that the squeeze container can be retained in the correct position for the viscous fluid to gravitationally descend toward the outlet or dispensing nozzle. Various configurations are suitable for various containers. It is, thus, an object and advantage of this invention to provide a cover stand, a cap stand or a stand suitable for supporting squeeze containers with the outlet on the bottom so that viscous fluid in the container gravitationally descends to a position adjacent the outlet or dispensing nozzle.

It is a further object and advantage of this invention to provide a cover stand, cap stand, or stand which serves as a cover for the outlet to protect the outlet from contamination.

It is a further object and advantage of this invention to provide a cover stand, cap stand, or a stand for squeeze containers which may serve as a security cover or as a means to enhance security of the container. This is particularly useful when the viscous fluid is a food item.

Other objects and advantages of this invention will become apparent from a study of the following portion of the specification, the claims and the attached drawings.

DESCRIPTION OF THE PREFERRED EMBODIMENTS

Figure 1:
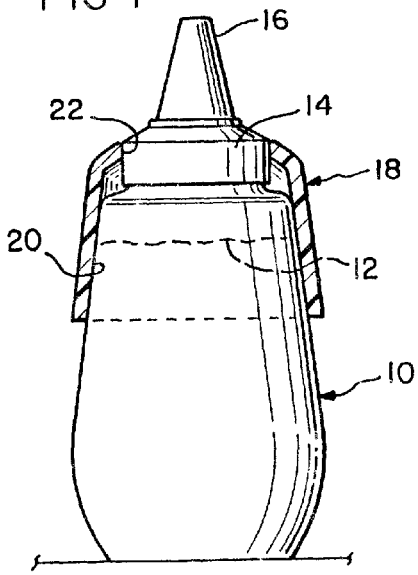
FIG. 1 is a side-elevational view of a squeeze container standing with its outlet on the top and a first preferred embodiment of a stand shown in section positioned as a collar on the squeeze container.
Figure 2:
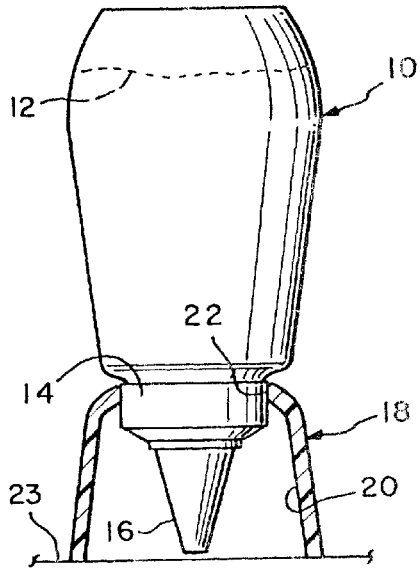
FIG. 2 is a similar view, showing the squeeze container in the outlet down position and the stand engaged on the cap supporting the container in that position.

The container 10, shown in FIGS. 1 and 2, is a hollow vessel made of flexible synthetic polymer composition material such as polyvinyl chloride, polyethylene, or similar non-toxic, flexible material so that it is squeezable to dispense contents. The material may be white, transparent, colored transparent, translucent, or opaque of such colors as may be desirable. The container 10 is for holding viscous materials, and particularly viscous food material such as catsup, mustard, mayonnaise or honey.

The viscous fluid material is illustrated in container 10 as having a fluid-air interface 12. The container has a detachable cap 14 which carries thereon dispensing nozzle 16. The nozzle 16 may be of such type as to be movable from an open to a closed position by movement of the outer part of the nozzle. Most squeeze containers stand with the outlet up. When dispensing of the viscous fluid is desired, inversion of the squeeze container does not immediately place the viscous material at the nozzle. The user must wait until the viscous fluid flows down to the nozzle. Thereupon, squeezing of the squeeze container will dispense the viscous fluid from the nozzle 16. In order to avoid this delay, the stand 18 is provided.

The stand 18 is a body of revolution with an inside surface 20 and a wall of substantially uniform thickness. Its collar opening 22 is sized to detachably engage on cap 14. The configuration of the stand 18 is such that, when the squeeze container is marketed, the stand engages on cap 14 and around the upper body part of the squeeze container 10, as seen in FIG. 1. As an additional feature, the stand 18 can serve as a safety cover to assure that the cap 14 is retained on container 10 from just after the filling of the container until consumer use thereof. To accomplish this, the stand 18 can be molded with the cap 14 with breakaway tabs attaching them. In the case of a cap 14 which is screwed onto the container 10, the inside surface 20 of the stand would engage the container in such a manner that rotation would not be permitted until the stand is broken away from the cap. In this way, removal of the cap would necessitate breaking of the seal between the stand and cap so that such would be visible. When the consumer breaks loose the stand, he inverts it over the cap, as shown in FIG. 2. From then on, he stores the squeeze container with the nozzle 16 down. In this position, the viscous material always lies next to the nozzle so that squeezing will dispense fluid material. In the embodiment in FIGS. 1 and 2, the stand has an open bottom and the dispensing nozzle has its own shutoff. Therefore, the stand can remain in place on the container during dispensing. The container is lifted so that the stand 18 is raised from the supporting surface 23, the nozzle 16 is opened, and the material is dispensed. When dispensing is complete, the nozzle 16 is closed and the container is returned to the position of FIG. 2. In this way, viscous fluid can be readily dispensed.

Figure 3:
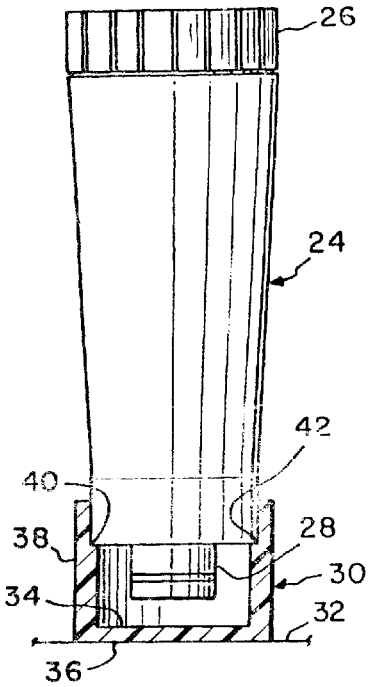
FIG. 3 is side-elevational view of a squeeze container having a top filler cap and with its outlet in the bottom position and with its cover stand taken in section.

Container 24, shown in FIG. 3, is also a flexible squeeze container for containing viscous fluids. It is configured so that it has a filler cap 26 at the top. A large filler opening is provided due to the viscosity of the fluid dispensed. At its lower end, the container 24 has a dispensing nozzle 28. The dispensing nozzle 28 is of such nature that, when pressure is created inside the container by squeezing the container, the dispensing nozzle opens to dispense the fluid. When the pressure is released by stopping the squeezing, the dispensing nozzle automatically closes to prevent dripping. Such nozzles are known, for example those shown in U.S. Pat. Nos. 4,420,101; 4,474,314; 4,506,809; and 4,747,518.

Cover stand 30 is a body of revolution about an upright axis normal to the support surface 32. The cover stand 30 has a base 34 which has an undersurface 36 which supports both the container and the stand 30 on the support surface 32. The cover stand 30 has continuous side walls 38 which include a shoulder 40 into which releasably fits the lower corner 42 of its base and side walls, and these are preferably integrally formed, such as by being molded of fairly rigid synthetic polymer composition material. In this configuration, the cover stand 30 can be detachably secured to the container 24 to serve as a protector for the dispensing nozzle between filling of the container and its final use. The container and cover stand 30 can be sealed together so that their separation is visible to provide protection to the consumer. When the consumer receives the container 24, he breaks loose the cover stand 30, and he replaces the container supported by the cover stand 30. When he wants to dispense the viscous fluid from the container 24, he lifts the container out of the cover stand 30, squeezes the container 24 to dispense the viscous fluid, and thereupon replaces it in the cover stand 30. In this way, the viscous fluid is always close to dispensing nozzle 28 for convenience of dispensing.

Figure 4:
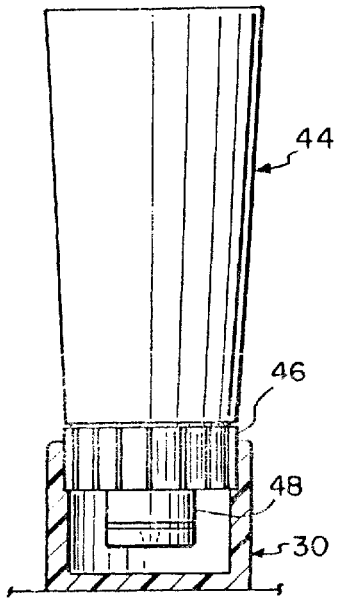
FIG. 4 is a view similar to FIG. 3, but with its filler opening on the same end as the dispensing opening.
Figure 5:
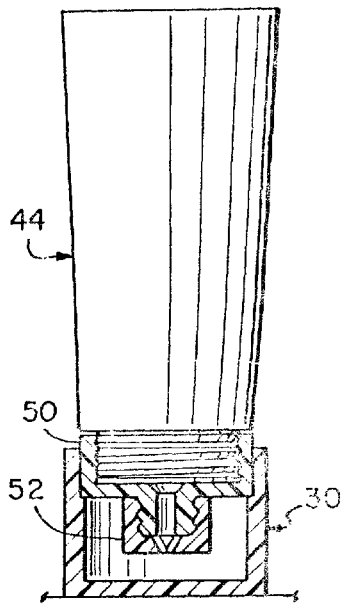
FIG. 5 is a view similar to FIG. 4 showing in section the cap with the dispensing opening.

The same cover stand 30 is shown in FIGS. 4 and 5. In FIG. 4, the squeeze container 44 is closed at the top and has its large filler opening covered by cap 46. Dispensing nozzle 48 is the same as nozzle 28, but is integrally formed with cap 46. In FIG. 5, the dispensing container 44 is the same. In this case, the cap 50 is detachably attached to the lower end of squeeze container 44, such as by screw threads. The dispensing nozzle 52 is the same as nozzle 28 and is detachably secured, as by screw threads, to a nose on the lower portion of cap 50.

Figure 6:
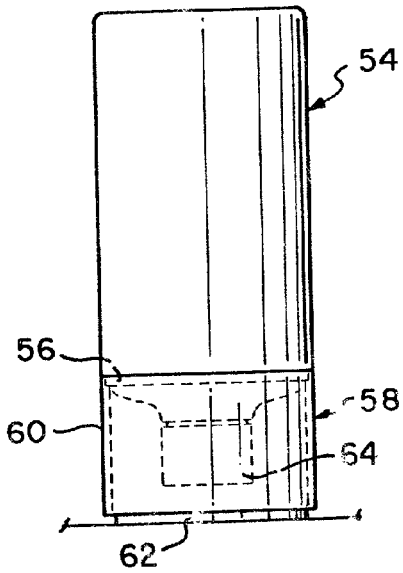
FIG. 6 is a side-elevational view of a squeeze container and a cover stand wherein the squeeze container is oval in transverse section.
Figure 7:
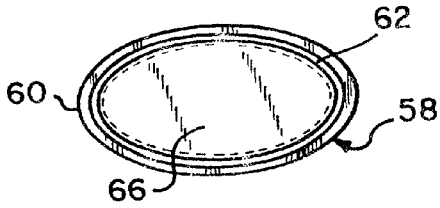
FIG. 7 is a plan view of the cover stand of FIG. 6.
Figure 8:
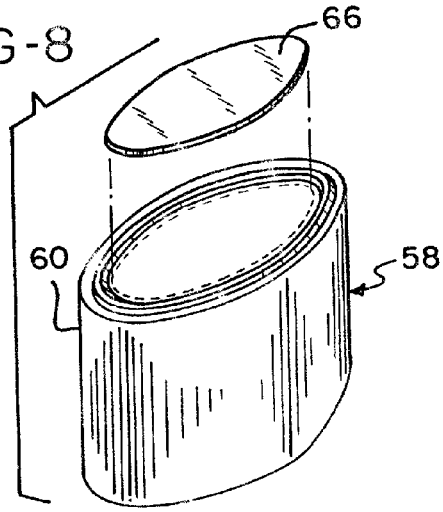
FIG. 8 is a perspective view thereof, showing the central base section of the cover stand as a knockout section.

The squeeze container 54 shown in FIG. 6 is also the type which is used for dispensing viscous liquids. While food-type materials have been previously discussed, it is also clear that other viscous liquids are dispensed or could be dispensed from squeeze bottles. Such liquids include hand creams, body lotions, sunscreens, gels, oils, and shampoos. In many such cases, the squeeze container is not circular in a transverse section, but is oval or elliptical. The squeeze container 54 has a shoulder 56 thereon so that the squeeze container can stand on cover stand 58. As seen in FIGS. 7 and 8, the cover stand 58 is of oval or elliptical configuration, as described above, to suit the cross section of the squeeze container 54. The side walls 60 of the cover stand 58 are sized and configured to fit the shoulder 56. The side walls 60 are continuous and are integrally formed with base 62 so that the squeeze container 54 can stand with its dispensing nozzle 64 in the down position. The dispensing nozzle 64 is the same as dispensing nozzle 28 so that dispensing of viscous liquid occurs when the squeeze container 54 is squeezed.

The cover stand 58 stays in place from shipping to use, but to provide egress for the viscous fluid dispensed by the dispensing nozzle 64, the base panel is a knockout panel 66, as seen in FIG. 8. It can be knocked out along lines made therein during manufacture. Injection-molding the cover stand 58 out of synthetic polymer composition material is a convenient and inexpensive way to obtain the desired shape and to create the panel 66, which can be readily knocked out. The user purchases the squeeze container 54 with viscous liquid therein and with the cover stand 58 in place. When he gets it to the place of use, he knocks out base panel 66 and stands the squeeze container with its nozzle down on stand 58. In this way, it is always ready for use.

Figure 10:
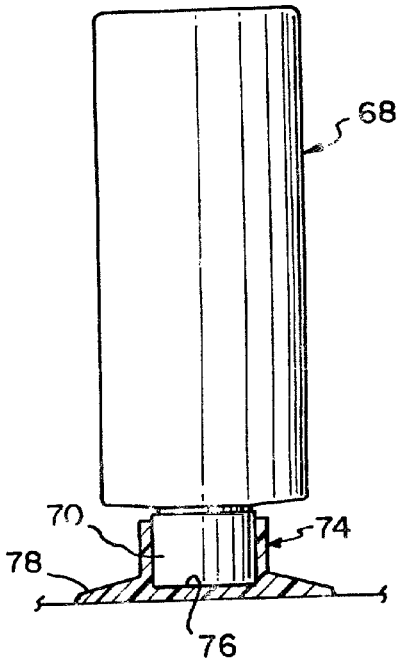
FIG. 10 is a view similar to FIG. 9 showing the squeeze container in position in its cap stand.
Figure 11:
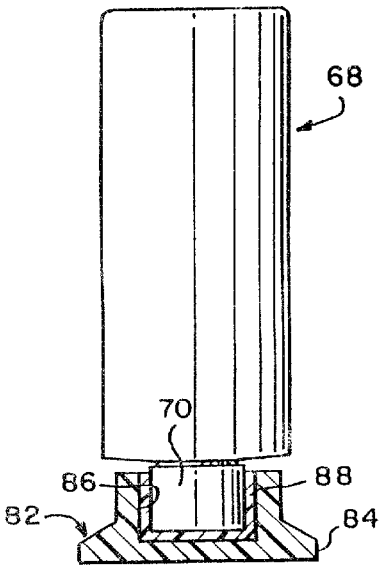
FIG. 11 is a similar view showing the type of cap stand seen in FIGS. 9 and 10, but with an insert which permits the stand to be used with squeeze containers of different size dispensing nozzles.

The container 68 shown in FIGS. 91 10 and 11 is a squeeze container for containment and dispensing of viscous fluids. The viscous fluids may be the viscous food materials previously described, the viscous body treatment fluids previously described, or other types of viscous fluids. Container 68 has a cap 70 which has a tilt nozzle 72. When the tilt nozzle is flush with the lower surface of the cap 70, the valve therein is closed. When the tilt nozzle is moved below the lower surface of the cap, the interior valve is open. When the squeeze container 68 is lifted out of its base 74, the tilt nozzle is manually opened for dispensing. When the container is returned to its base, the interior bottom wall 76 of the base presses the tilt nozzle to its valve-closed position. Base 74 has a large foot, preferably in the form of a flange 78, which is sufficiently wide to support the container 68 without substantial danger of tipping. The base 74 has walls 80 which freely receive cap 70. In this way, the squeeze container can be readily placed in the base for support of the squeeze container within the nozzle-downward position and can be easily lifted out of the base. The squeeze container 68 is lifted out of its base for dispensing of viscous materials in the same manner as the squeeze containers illustrated in FIGS. 3, 4 and 5. FIG. 10 illustrates the container 68 supported in its base 74, ready for removal, opening of the tilt nozzle 72, and dispensing.

FIG. 11 shows the same squeeze container 68 with its cap with tilt nozzle. The difference is in base 82. Base 82 has a supporting flange 84 which is also of sufficient width to properly support the squeeze container 68. The diameter of the flanges 78 and 84 preferably at least equal to the diameter of the squeeze container. In this case, the base 82 has a larger recess 86 suitable for larger dispensing cap 70 and also has an adaptor 88 therein so that the base 82 can be used with the squeeze container 68. When a different squeeze container having a larger cap than cap 70 is used, the adaptor 88 is removed so that the new cap loosely fits within recess 86. In this way, base 82 can be used as support for squeeze containers having different sized caps. In this case also, the squeeze container is lifted out of the base and out of the adaptor, the nozzle is opened to dispense viscous liquid out of the squeeze container, and thereupon, the squeeze container is placed back in the base so that the base closes the dispensing nozzle. The squeeze container remains in the outlet-downward position when not in use so that the viscous material remains adjacent the dispensing nozzle for quick and convenient dispensing.

Figure 12:
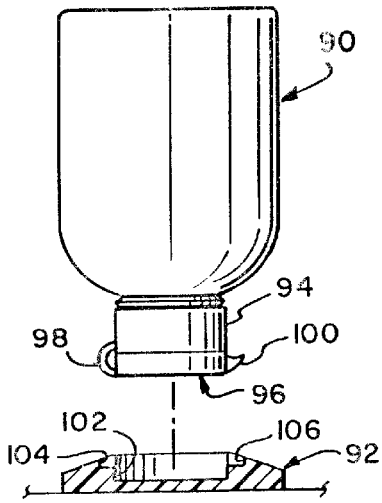
FIG. 12 is a side-elevational view of a squeeze container having a bottom outlet in association with its cap stand, with the cap stand taken in section.
Figure 13:
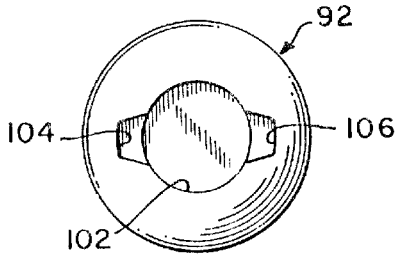
FIG. 13 is a plan view of the cap stand of FIG. 12.

FIGS. 12 and 13 illustrate squeeze container 90 with its base 92. The squeeze container 90 is generally of circular cross section and is made of flexible synthetic polymer material so that it can be squeezed. The container 90 is suitable for the containment of viscous liquids. The container 90 has a neck at its lower end and cap 94 on the neck. When the container 90 is filled, the cap 94 is not installed. It may be permanently or detachably installed after filling. Cap 94 has a dispensing opening therethrough. Cover 96 is hingedly mounted to cover and uncover the dispensing opening. Cover 96 is preferably integrally molded with the cap, with the living hinge 98 permitting the opening of the cover off of the dispensing opening. Flange 100 is integrally formed on the cover opposite the hinge for convenient engagement by the finger. With the squeeze container 90 taken out of the cap stand 92 as shown in FIG. 12, the finger can pull down on the flange, swing the cover out of the way so that the container can be squeezed and the viscous fluid is dispensed through the dispensing opening in the cap.

Cap stand 92 has a recess 102 therein which is sized to firmly receive the cover of the squeeze container 90. The size of the recess is such as to firmly receive the cover for press fit and support the squeeze container 90 in the outlet-down position. In order to provide space for the hinge and flange 100, relief recesses 104 and 106 are respectively provided. When the squeeze container 90 and cap stand 92 are picked up together, the cap stand 92 and cover are swung down together to expose the outlet for dispensing. After dispensing, the cap stand 92 and cover are swung up on the cap hinge to the cap closed position and the container and cap stand 92 are replaced on the rest surface.

Figure 14:
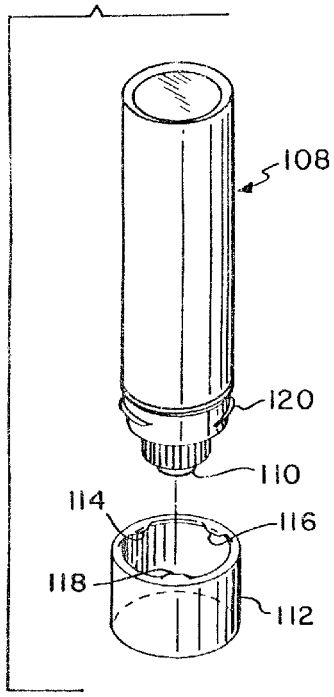
FIG. 14 is a perspective view of the squeeze container with bottom outlet together with the stand which detachably attaches to the squeeze container.

Squeeze container 108, illustrated in FIG. 14, has a dispensing nozzle 110 at its lower end. The dispensing nozzle is preferably the same as the dispensing nozzle 28 and, thus, dispenses viscous fluid from the squeeze container when the squeeze container is squeezed. In order to support the squeeze container 100 in the nozzle-down position, stand 112 is provided. The stand 112 is a substantially cylindrical tubular stand which has no bottom wall and, thus, can be semi-permanently attached to the squeeze container. Ears 114, 116 and 118 are formed at the top of the circular side walls of the stand 112 and project inwardly. They are sized to detachably engage with threads 120. The threads 120 are on the body of squeeze container 108. In the case where the stand 112 has a bottom wall, the stand can also serve as a cover. Due to the open threads, in that case, the container can be lifted out of the cover stand for dispensing.

Figure 15:
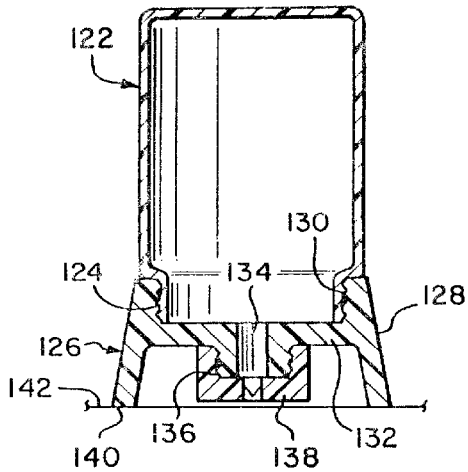
FIG. 15 is a central section through a squeeze container with a stand which serves as a container closure and a dispensing nozzle attachment.

FIG. 15 illustrates a similar squeeze container 122. The squeeze container 122 has a large open fill neck which carries exterior threads 124. Stand 126 has exterior walls 128 of generally truncated conical form which are larger at the base. The upper interior of the walls contain threads 130 which engage on threads 124. Wall 132 extends across the stand. It has an interior opening 134 and a threaded nose 136 surrounding the opening. Dispensing nozzle 138 is threaded onto nose 136. The nozzle 138 is the same as nozzle 28. The walls 128 extend downward to bottom surface 140. When the bottom surface of the walls stand on support 142, for example a table top, the dispensing nozzle 138 is spaced above the support. The squeeze container 122 is thus suitable for containing viscous liquids and being supported in the outlet-down position so that gravitational forces cause the viscous liquid to lie at the nozzle. When the squeeze container 122 is lifted to a point where dispensing is to occur, the nozzle is already downward, and when in position, squeezing dispenses the viscous liquid. The dispensing nozzle cuts off flow at the end of squeezing and the squeeze container can be again be placed on the table in the nozzle-down position.

Figure 16:
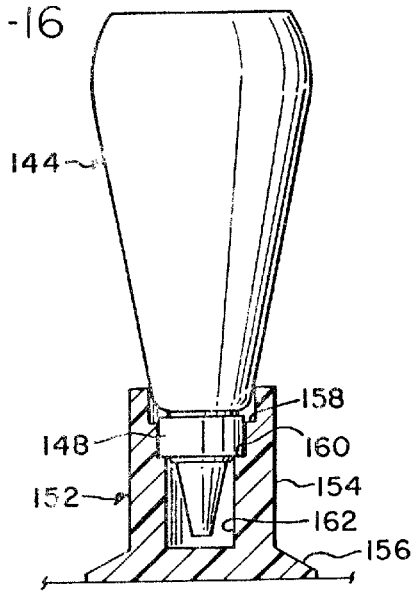
FIG. 16 is a side-elevational view of a squeeze container of a first size being supported with its outlet in bottom position in a cap stand, with the cap stand taken in center-line section.
Figure 17:
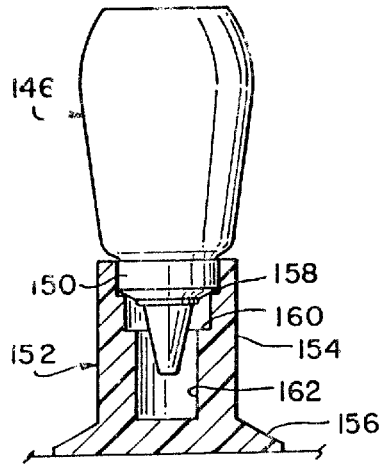
FIG. 17 is a side-elevational view of a second squeeze container of a different size supported with its outlet on the bottom in the same cap stand as FIG. 16.

Squeeze containers 144 and 146, shown in FIGS. 16 and 17 are each squeeze containers for containment of and dispensing of viscous liquids. They respectively carry caps 148 and 150 thereon, which have dispensing nozzles at the lower end. Cap stand 152 is the same for both of containers 144 and 146. Stand 152 has side walls 154 which extend downwardly and terminate in base flange 156. The base flange 156 is diametrically larger than the side walls 154 in order to provide adequate support for the squeeze container positioned thereon. Interiorly, the side walls define large shoulder 158 which is sized to receive the cap 150, see FIG. 17. Below shoulder 158 is small shoulder 160, which is sized to receive cap 148. In both cases, the nozzles on the caps are received in nozzle space 162. The sizes of the interior opening in the cap stand between the side walls above the flanges are respectively large enough to receive and support the respective squeeze containers, but also to readily release them. The squeeze containers can be lifted out of the cap stand without binding. In this way, the user can lift one or the other of the squeeze containers out of the cap stand in the nozzle-down position so that the viscous liquid therein is adjacent the cap and nozzle. After squeezing and dispensing of the viscous liquid, the squeeze container is returned to the cap stand into which it is placed to support the squeeze container with the nozzle in the downward direction.

Figure 18:
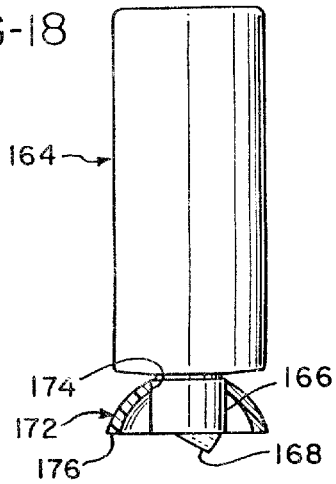
FIG. 18 is a side-elevational view of a squeeze container having a tilt-spout nozzle positioned on the bottom and with a cap stand engaged on the body of the nozzle.
Figure 19:
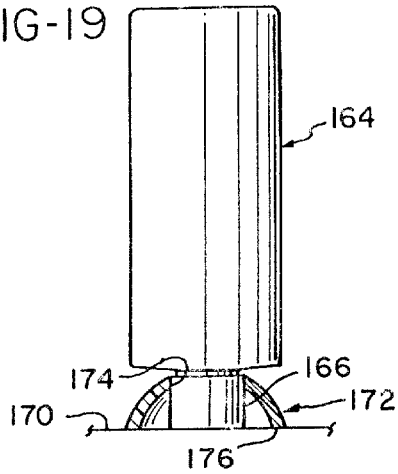
FIG. 19 shows the same squeeze container supported on a surface which closes the tilt-spout nozzle. The cap stand is shown in center-line section.

The squeeze container 164, shown in FIGS. 18 and 19, is a container for the dispensing of liquid material of high viscosity. It carries a cap 166 which has a tilt nozzle 168. One brand name for such a tilt nozzle is "Disc-Top" and another is "Polytop." In FIG. 18, the squeeze container 164 is in the raised position and the tilt nozzle 168 is open. This tilt nozzle is also similar to the tilt nozzle 72 shown in FIG. 9. Instead of a pivoted tilt nozzle, a valve opened by a push-pull ring could be used. In the position of FIG. 18, the container is lifted from its supporting surface 170, and the viscous liquid in the container can be dispensed by squeezing. In order to provide stability for the squeeze container 164 when resting in the nozzle-down position on the support surface 170, cap stand 172 is provided. The cap stand has an engagement opening 174 which engages around the cap 166 closely adjacent where the cap is attached to the squeeze container. When engaged in this position, the bottom surface 176 is slightly below or is substantially in line with the bottom surface of the cap 166. With this configuration, when the squeeze container is returned to the support surface 17D, as shown in FIG. 19, the support surface 120 closes the tilt nozzle 168. Thus, the act of returning the squeeze bottle to the support surface closes the nozzle at the same time the cap stand 172 supports the squeeze container in the nozzle-down position. The cap stand 172 is conveniently formed in the shape of a portion of a hollow sphere to provide a bottom surface 176 which is at least as large in diameter as the squeeze container to provide adequate support.

Figure 20:
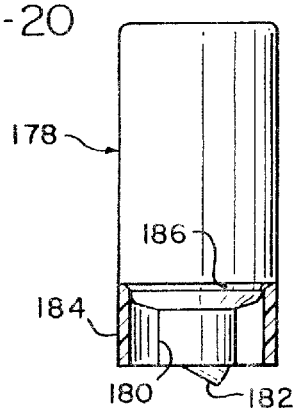
FIG. 20 is similar to FIG. 18, but shows the stand supported on the body of the squeeze container.
Figure 21:
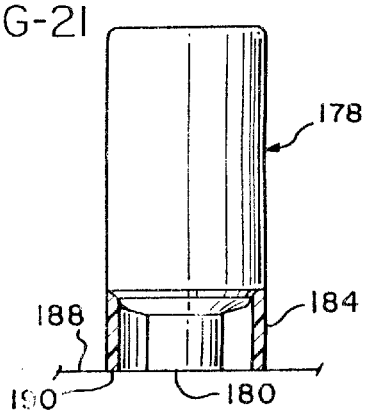
FIG. 21 is similar to FIG. 19 showing the stand of FIG. 20.

The squeeze container 178, shown in FIGS. 20 and 21, is similar to the squeeze container 164. The squeeze container 178 is structured so that it can contain viscous liquid and can be squeezed to dispense the viscous liquid. The squeeze container 178 carries cap 180 at its bottom outlet. The cap 180 has a tilt nozzle 182 which is shown open in FIG. 20. When open and in the raised position shown in FIG. 20, squeezing of the squeeze container 178 dispenses viscous liquid from the interior of the container out of the nozzle 182. The nozzle 182 is thus similar to the nozzle 168. Stand 184 is a cylindrical tube which engages upon shoulder 186 on the squeeze container adjacent the nozzle. Stand 184 is preferably semi-permanently attached onto the shoulder, similarly to stand 172, because it need not be moved for dispensing the viscous fluid. When the squeeze bottle is raised above its supporting surface 188, the tilt nozzle 182 can be opened and the material dispensed. When the squeeze container is replaced on the supporting surface, as seen in FIG. 21, the supporting surface closes the tilt nozzle. This is occasioned by the fact that the bottom surface 190 of the stand 184 is on the same plane as the bottom of the cap 180, see FIG. 21. This permits convenient raising of the squeeze container, opening the nozzle, dispensing the viscous liquid, and replacing the squeeze container on the support. Since the stand is as wide as the squeeze container, adequate support is provided to retain the squeeze container in its outlet-down position.

Figure 22:
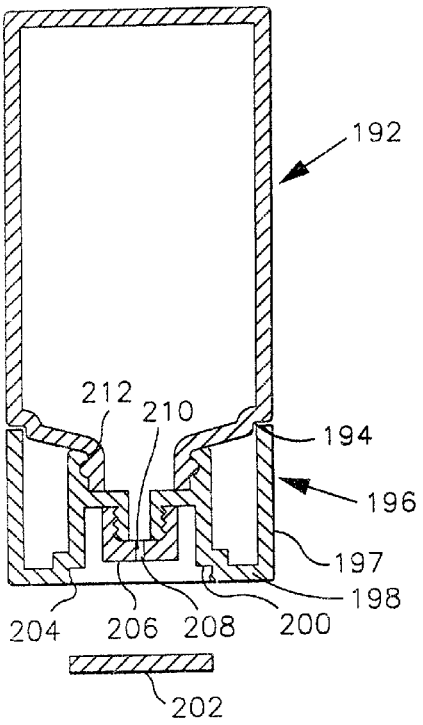
FIG. 22 is a central section through a squeeze container with a cover stand which serves as a container closure and a dispensing nozzle attachment along with a detachable base panel.

FIG. 22 illustrates a squeeze container 192 with a cover stand 196 which serves as a container closure and a nozzle holder. There is a snap bead fit 212 between the neck of the container and cover stand and an interior opening 210 and a threaded nose surrounding the opening similar to FIG. 15. The automatic nozzle 206 with orifice 208 is similar to nozzle 28. Sidewalls 197 extend from the base 198 to the shoulder of the container 194 similar to FIG. 6. Detachable base panel section 202 fits snugly against dispensing nozzle and is held in place by in base panel recess 200 by snap fittings 204. Of course, various other combinations could be utilized therein, such as the container and cover stand having a threaded connection between them and/or a dispensing nozzle could be snapped on to, or bonded to the cover stand as proposed with other embodiments.

The size of the detachable base panel 202 in this embodiment as well as FIG. 6 and others could vary widely for various applications and various automatic nozzles. For example if an automatic dispensing nozzle with a manual rotary shut-off device such as U.S. Pat. No. 4,506,809 were incorporated into an embodiment, the design of the stand and detachable base panel probably would incorporate enough room for the user to easily reach inside with his fingers to turn the manual shut-off device. Various attachment means could be utilized to hold the detachable base panel section in place.

Figure 23:
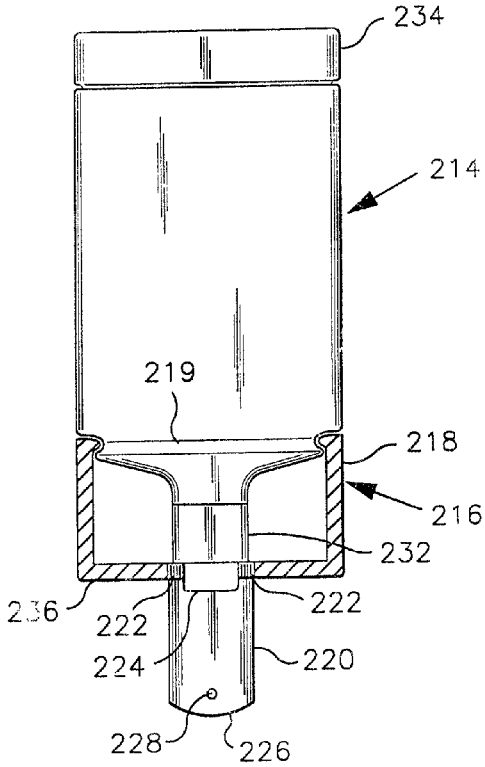
FIG. 23 is a side elevation view of a squeeze container similar to FIG. 6 with a cover stand, having a detachable base panel connected to the base wall by a hinge. Cover stand is taken in section and squeeze container has a top filler cap.
Figure 24:
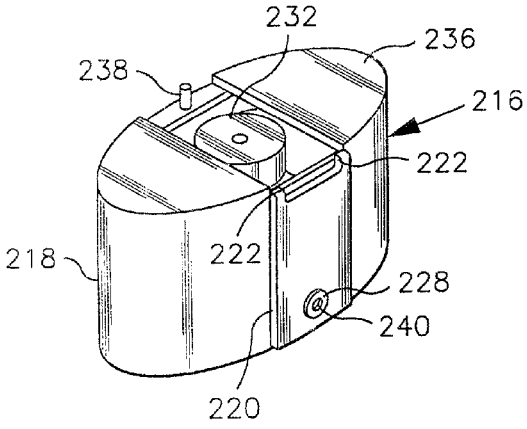
FIG. 24 is a perspective view of cover stand of FIG. 23 with the detachable base panel attached to the back wall of cover stand.
Figure 25:
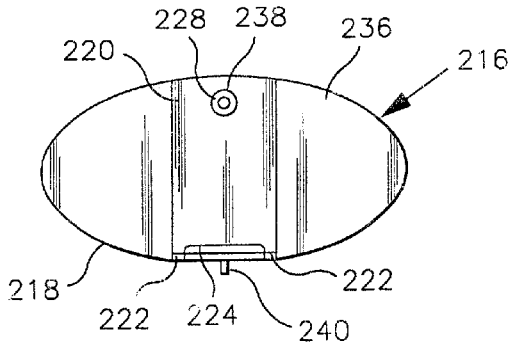
FIG. 25 is a bottom view of the cover stand of FIGS. 23 and 24 with the detachable base panel section attached to the base wall of cover stand.

Squeeze container 214 shown in FIG. 23 has a cover stand 216 with side walls 218 attached to the shoulder of the container 219. Base panel flap, nozzle cover, 220 is connected to base wall 236 by hinges 222. The base panel flap could be a separate piece with a hinge means that matingly engages a corresponding hinge means on the cover stand 216 but ideally the cover stand and base panel flap would have an integrally molded hinge connected to the stand. This would eliminate a costly assembly step. The base panel flap has a relief recess 224 between the hinges and a fitting 228 for snap attachment purposes, and a lip 226. Base panel flap could range in size from as large as the entire base wall to as small as just large enough to expose the nozzle orifice. Nozzle 232 is similar to nozzle 28 and container has a top refill cap 234. As can be seen in FIG. 24 and FIG. 25 the detachable base panel flap is attached to the side wall of cover stand 216 by snap fitting 240 and to the bottom of base wall by snap fitting 238. A wide variety of attachment methods and/or techniques could be incorporated for various alternate embodiments to keep the base panel flap in place covering the nozzle in one configuration and, in the alternate configuration, keeping the nozzle in an unrestricted mode. A wide variety of alternate shapes could be incorporated into this and other cover-stand structures and embodiments, including, but not limited to rectangular, square, round etc.

Figure 26:
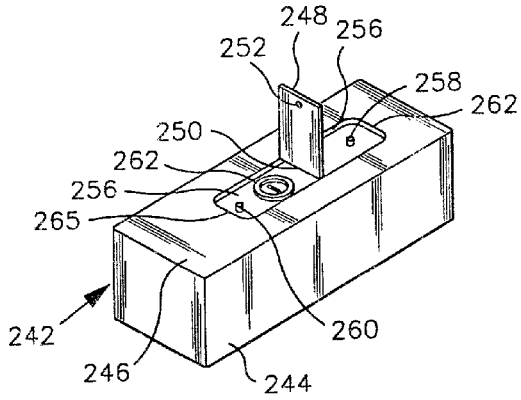
FIG. 26 is a perspective view of a cover stand having a base panel flap. This cover stand serves as a container closure and an automatic dispensing nozzle holder and cover.
Figure 27:
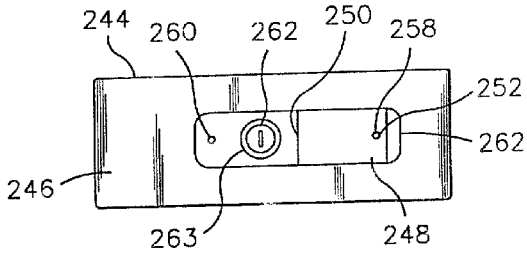
FIG. 27 is a bottom view of the same cover stand of FIG. 27 with the base panel flap attached to the base wall with the automatic nozzle exposed.

FIG. 26 and FIG. 27 shows a rectangular cover stand 242 having side walls 244 and a base wall 246 a base panel flap 248 with a hinge 250, and a snap fitting 252 for attachment purposes. Base wall has a recess 256, snap fittings 258 and 260 and finger recesses 262 and 265. Base wall recess has a opening 263 for dispensing nozzle 262 which is similar to nozzle 28. The base panel flap snaps into the base panel recess with snap fittings 252 and 258 engaged during normal use and snap fittings 260 and 252 engaged during shipping and travel. An alternate embodiment could be for the neck of the container and corresponding position of the automatic nozzle to be offset toward one end of the base, making more efficient use of the base panel when a base panel flap is utilized on a base wall of a cover-stand.

Figure 28:
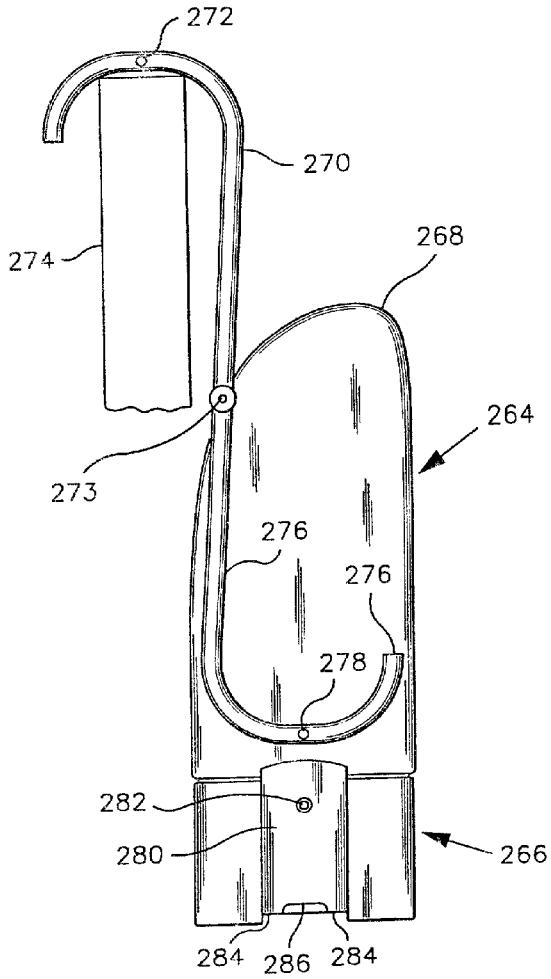
FIG. 28 is a side elevation view of a squeeze container containing an automatic nozzle and a cover stand having a base panel flap affixed to the back of the cover stand. A hook suspends container in the nozzle down position.

FIG. 28 shows the back side of squeeze container 264 containing an automatic nozzle similar to nozzle 28 and a cover stand 266 with internal structure similar to FIG. 22 and having a base panel flap 280 with hinges 284 and recess 286 attached to the back side wall of the cover stand 266 by snap fitting 282. A hook 270 containing a hook orifice 272 attached to container by pivot 273 suspends container over shower door 274 in the nozzle down position. The hook orifice could be utilized for alternate hanging methods such as screws or nails or a suction cup fastened thereon. When not needed the hook is stored on the back of the bottle in hook recess 276 and kept in place by snap fitting 278. An alternate embodiment would be to have a hook molded into the bottle for hanging purposes. Container has a rounded top wall 268 to prevent storage in an inverted position and to insure the viscous fluid is always positioned against nozzle in the lower portion of the container.

Figure 29:
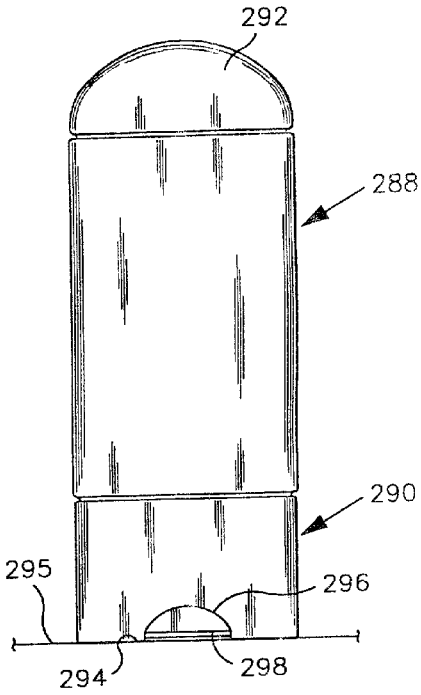
FIG. 29 is a side elevation of a squeeze container and cover-stand similar to FIG. 28 with a refill cap having a domed top.

Squeeze container 288 and cover stand 290 shown in FIG. 29 is similar to FIG. 28 with the bottom wall 294 resting on a horizontal surface 295. Cover stand 290 has a recess 296 for easy access to base panel flap 298. The refill cap 292 has a domed shape to prevent storage in an inverted position and to insure the viscous fluid is always positioned against automatic nozzle in the lower portion of the container. Refill cap has a quick close ¼ turn feature that snaps as it reaches the closed position. It is imperative that a refill cap on a refillable dispenser be closed tightly in order to develop the internal pressure to activate the automatic nozzle when the container is squeezed.

Figure 30:
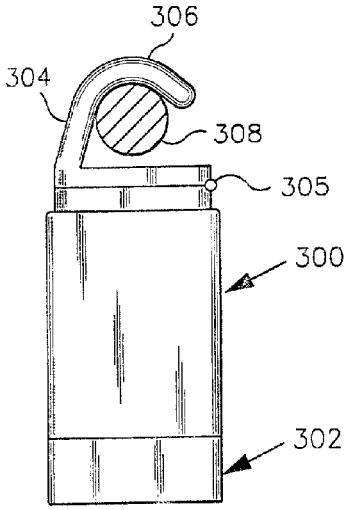
FIG. 30 is a side elevation view of a suspended squeeze container and a cover stand with an automatic nozzle and a refill cap that is also a hook with a hinge means.
Figure 30A:
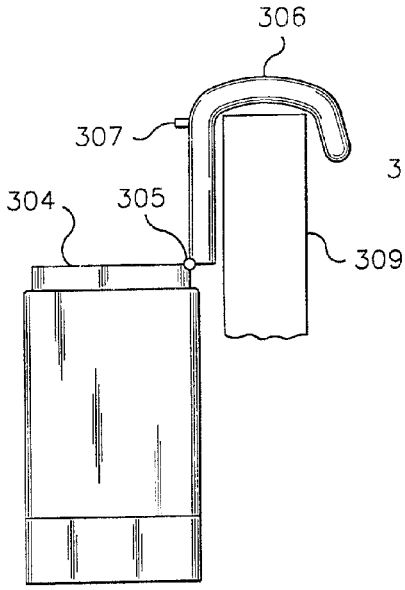
FIG. 30*a* shows the same squeeze container of FIG. 30 with the hook of the refill cap swung to an alternate position on the hinge.
Figure 31:
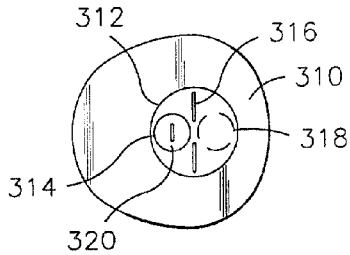
FIG. 31 is a bottom view of the cover stand of FIG. 30 with a rotary cover element in a position with the automatic dispensing nozzle exposed.
Figure 32:
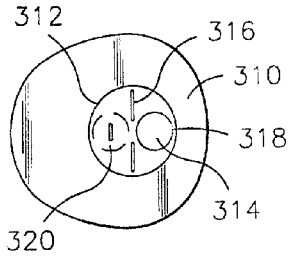
FIG. 32 is a bottom view of the cover stand of FIG. 30 and FIG. 31 with a rotary cover element in a position with the automatic dispensing nozzle blocked.

FIG. 30 shows a squeeze container 300 and a cover stand 302 with an auto-nozzle and a refill cap 304 that is also a hook with a hinge means 305 incorporated therein; with the hook section 306 over a shower pipe 308. FIG. 30*a* shows the refill cap-hook rotated showing snap fitting 307, hanging over a door 309. FIGS. 31 and 32 show the bottom wall 310 of the cover stand with a rotary cover element 312 having an opening 314 which covers or uncovers automatic dispensing nozzle and finger tabs 316 for aid in rotating the element. Automatic nozzle 320 is similar to nozzle 28. A protrusion 318 in the base wall keeps the rotary element from moving when the nozzle is blocked and also when the nozzle is in the unrestricted configuration.

Figure 33:
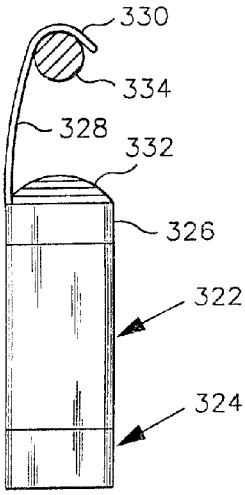
FIG. 33 is a side elevation view of a suspended squeeze container and a cover stand with an automatic nozzle and a refill cap that is also a hook.
Figure 34:
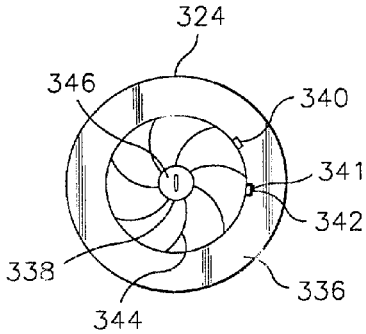
FIG. 34 is a bottom view of the cover stand of FIG. 33 with an iris type cover element in a position with the automatic dispensing nozzle exposed.
Figure 35:
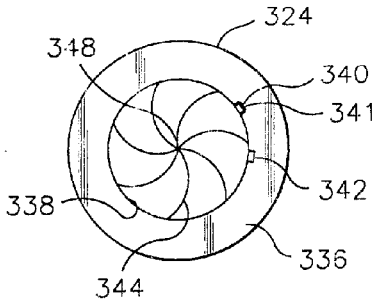
FIG. 35 is a bottom view of the cover and stand of FIG. 33 and FIG. 34 with an iris type cover element in a position with the automatic dispensing nozzle blocked.

Suspended squeeze container 322 with a cover stand 324 with an automatic nozzle can be seen in FIG. 33. Refill cap 326 has a hanging means 328 molded into it with a hook portion 330 positioned over shower pipe 334. Top of refill cap has groves 332 for storing the hook when not needed and a rounded top to prevent storage in an inverted position on refill cap. Base wall 336 of cover stand shown in FIGS. 34 and 35 has an iris type cover element 338 with iris panels 344 and a mechanism 341 that slides from one position 340 where the dispensing nozzle is covered to a second position 342 where the dispensing nozzle 346 is exposed. This cover device functions much like the iris in a camera.

Figure 36:
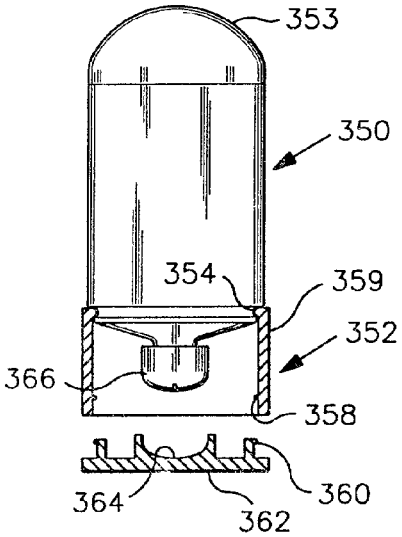
FIG. 36 is a side elevation view of a squeeze container with an associated automatic nozzle and with a cover stand and a refill cap. The cover stand taken in section and a refill cap has a rounded top.

FIG. 36 shows a squeeze container 350 with an associated automatic nozzle 366 and with a cover stand 352 and a refill cap 353 having a domed top to prevent storage in an inverted position on the refill cap. The cover stand 352 is snapped onto the shoulder 354 of container. The base wall panel 362 has a snap fitting 360 that matingly engages with a corresponding snap fitting 358 on the stand portion 359. The inside surface 364 of the base panel is sized to match the corresponding outside surface of the dispensing nozzle 366 so that when the base panel is snapped in place, the surface of the base panel and the surface of the dispensing nozzle tightly matingly engage with each other.

Figure 9:
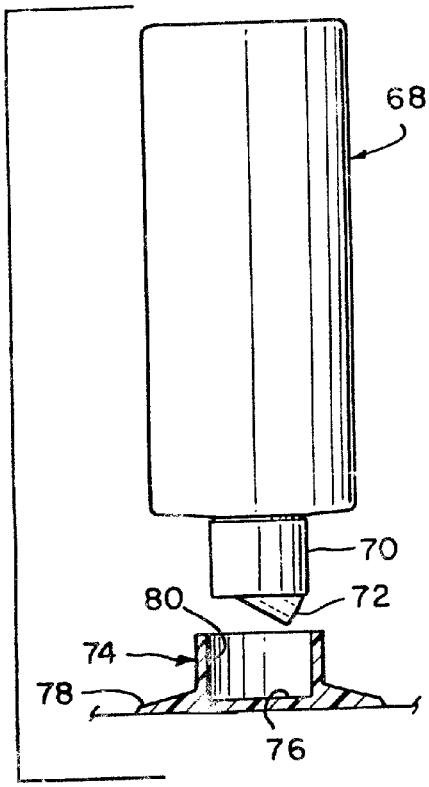
FIG. 9 is a side-elevational view of a squeeze container and cap stand wherein the stand has a closed bottom to serve as a closer for a tilt spout bottom dispensing nozzle.

The automatic dispensing nozzles discussed in the various embodiments, in general, function the same way, that is, they allow flow when the container pressurized by squeezing forces, and cut off the flow when the squeezing forces are removed. However since there are many patented automatic nozzles, some may have features that are more suitable than others for different embodiments. Some of the automatic nozzles have a positive shut-off feature. This would be important for containers during shipment for example. Also, for travel purposes when a user packs a self sealing squeeze container filled with condiments or shampoos in a suitcase or backpack for example, inadvertent squeezing of the container would discharge the contents if there was no shut-off device incorporated therein. Some of the automatic nozzles are very complicated devices and some are very simple. For example U.S. Pat. No. 1,825,553 issued in 1931, U.S. Pat. Nos. 2,175,052 issued in 1939, and 2,193,517 issued in 1940 are some simple one piece "automatic valve closures" originally proposed for tubes filled with "shaving creams and toothpastes and other viscous substances". These one piece designs were made from vulcanized rubber or other "elastic material" and had quite a variety of shapes to their closure end wall— concave, convex, domed, horizontal, etc. and a variety of proposed orifice designs. The simplicity of the designs make them very desirable for some of the embodiments described herein. Utilizing today's materials and high volume injection molding techniques and varying the designs for different applications could produce a very inexpensive automatic dispensing nozzle. Several of the embodiments described herein including FIGS. 5, 15, 22, 23, 26, 28, 29, 36 and 41 show one piece automatic dispensing nozzles. One thing these one piece dispensing nozzles have in common is that when they are functioning, they flex because of the elastic nature of the material they are manufactured from. When the container is squeezed producing a pressure force, the end wall flexes and the dispensing orifice is opened and the viscous fluid is extruded. In order to provide a positive shut-off with these one piece nozzles a device is incorporated into the various embodiments that will keep the end wall from flexing thereby preventing flow. FIGS. 9, 10, and 11 show an embodiment wherein the inside bottom wall of the stand closes a mechanical nozzle. Similarly, the inside of the bottom wall of a stand or the inside wall of a base panel flap, or the inside wall of a detachable base panel could be designed to tightly matingly engage with the outside end wall of complex or simple automatic dispensing nozzles. If a rigid element is attached in place, matingly engaging with the end wall any automatic dispensing nozzle that flexes, the nozzle end wall could not flex, thereby providing a positive shut-off and preventing inadvertent discharge. U.S. Pat. No. 1,825,553 shows a one piece automatic dispensing nozzle fitted inside tube, a variation of that concept might be incorporated into some of the embodiments herein. A one piece automatic dispensing nozzle could be positioned over the container neck opening and be sandwiched between the neck of a container and the cover-stand.

Figure 37:
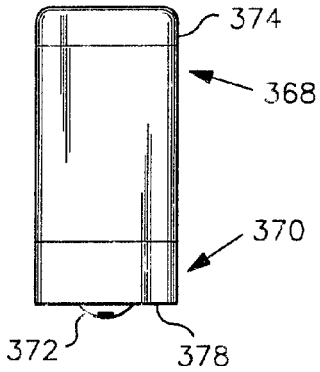
FIG. 37 is a front elevational view of a squeeze container with a refill cap and cap stand having a dispensing closure element showing it, when in the open position.
Figure 38:
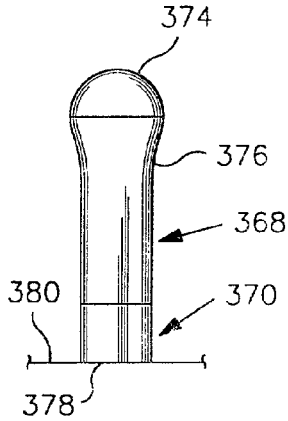
FIG. 38 is a side elevational view of the same squeeze container and cap stand of FIG. 37 showing a rounded refill cap and the dispensing closure element recessed into the cap stand when placed on a horizontal surface.

FIGS. 37 and 38 shows squeeze container 368 with a refill cap 374 and cap stand 370 having a element 372 that protrudes away from the stand when in an open position. The body of the container has contour 376 to enable the refill cap to be large for easy filling with viscous fluids. Closure element is forced closed as bottom wall 378 of cap stand is placed on horizontal surface 380.

Figure 39:
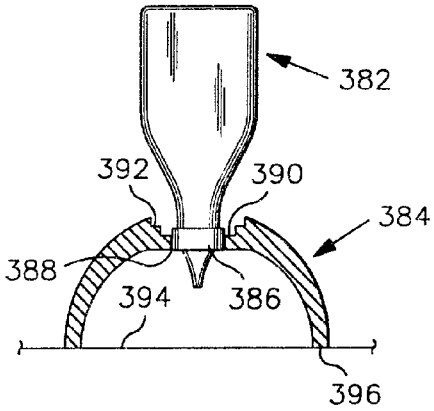
FIG. 39 is a side elevational view of a squeeze container of a first size being supported with its outlet in bottom position in a cap stand, with the cap stand taken in center-line section.
Figure 40:
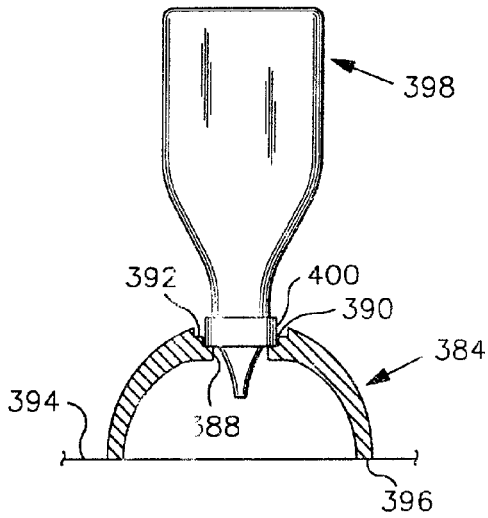
FIG. 40 is a side elevational view of a squeeze container of a second size being supported with its outlet in bottom position in the same cap stand as FIG. 39.

Squeeze containers 382 and 398 shown in FIGS. 39 and 40 having caps 386 and 400 respectively are for dispensing viscous fluids. The stand 384 is the same for both having an open bottom and sidewalls that extend from the cap and having a bottom surface 396 that can rest on a horizontal surface 394. The top of the stand has shoulders 388, 390 and 392 that are sized to matingly engage with the different caps of various squeeze containers. The size of the fit could be such that the containers could be placed in the stand and taken out in an unrestricted fashion or the fit could be tight wherein the container and stand remain attached and they are picked up together and the dispensing nozzle is toggled to an open position to dispense the viscous fluid and then closed before the container and stand are returned to the horizontal surface.

Figure 41:
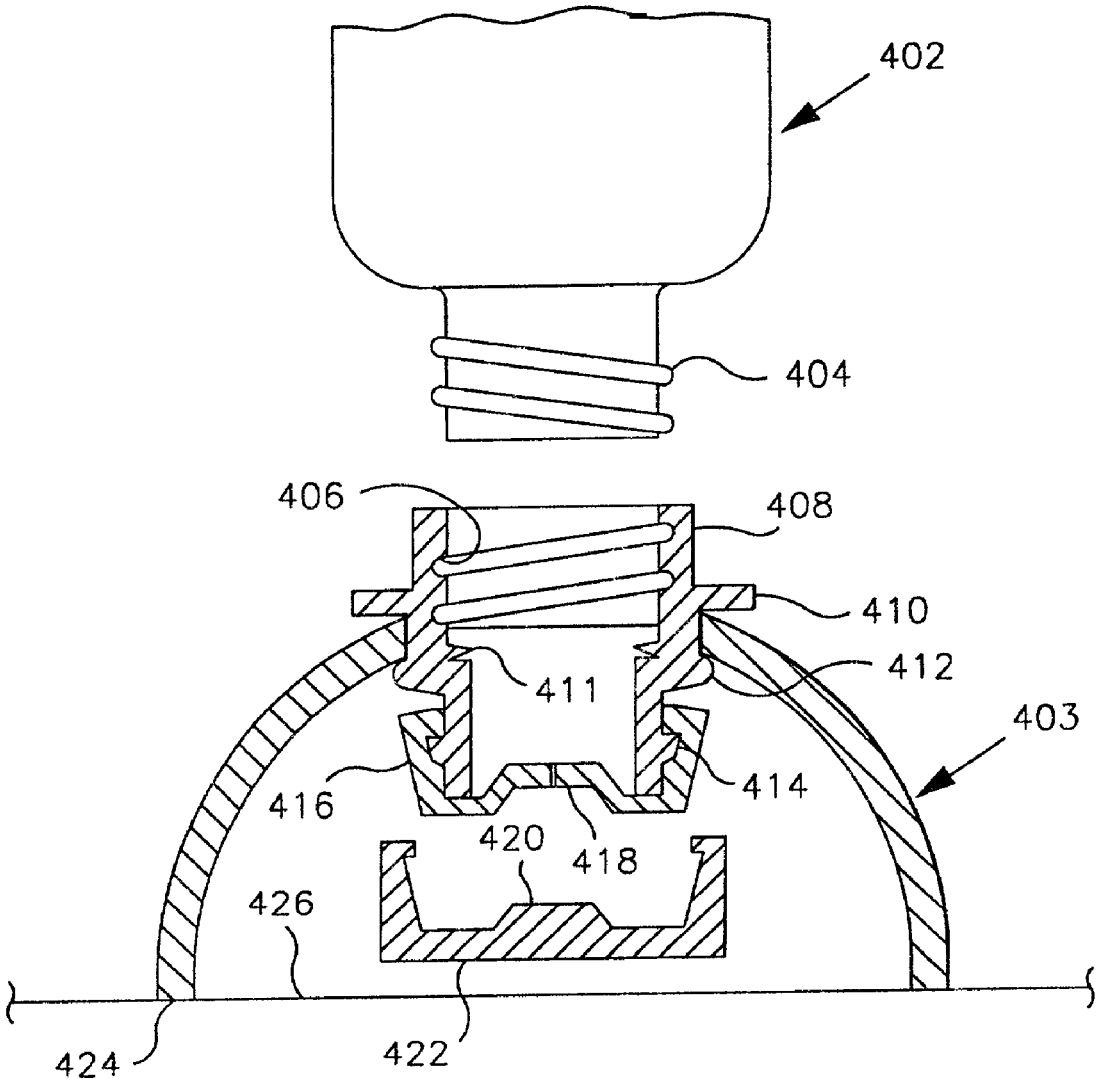
FIG. 41 is a partial side elevational view of a squeeze container and a cover stand, with a central section through the cover stand.

Squeeze container 402 shown in FIG. 41 having threads 404 that matingly engage with threads 406 on adapter means 408. Retaining tabs 410 and snap fittings 412 enable adapter means to detachably attach to stand means 403 which has an open bottom and has a bottom surface 424 that rests on horizontal surface 426. Adapter means has lip 411 that aids in leak resistance when neck of container is fastened to adapter means and a snap fitting 414 that matingly engages with snap fitting on automatic dispensing nozzle 416. Dispensing nozzle has a contour 418 and travel cap 422 has a mating contour 420 so that they matingly engage with each other when attached. Automatic dispensing nozzles have been available for many many years and squeeze bottles have been available for many years with numerous neck finishes and designs of dispensing nozzles. The problem is that has not been resolved is that there are many many neck finishes on squeeze bottles and typically automatic dispensing nozzles are manufactured in one neck finish. As an example automatic dispensing nozzle U.S. Pat. No. 4,506,809 manufactured by Calmar has a neck finish of 28 millimeters with a special thread finish. Most ketchup squeeze bottles have a 33 mm neck finish, most mustard squeeze bottles have a 38 mm neck finish and some have snap fasteners. Most shampoo bottles are either 24 or 28 mm with a different thread finish than the Calmar thread finish. What this embodiment provides is a simple apparatus that will convert virtually any squeeze bottle into a "just squeeze" package. With an adapter means, a stand means and an automatic nozzle all bottles could be transformed into a superior dispenser by making available the structure shown. The only portion that would have to be changed for different squeeze bottles would be the female portion of the adapter means to matingly match the male attachment means of various bottles. Alternate possibilities for the female side of the adapter include shoulders similar to FIGS. 16 and 17 with threads on the side walls of the shoulders to accommodate different size neck finishes of different containers; example: a female adapter with shoulders having 24 mm and 28 mm threads for shampoo bottles. Additionally, an adapter made with a resilient type of material with a means to accommodate different diameter necks would provide an adapter of more usefulness. If the automatic nozzle has a positive shutoff mechanism incorporated therein, a travel cap would not be needed. An alternate embodiment would be to incorporate the adapter of FIG. 41 with a detachable cover stand having a bottom wall similar to a version of the cover stand discussed in FIG. 14. A container and adapter means with an automatic dispensing nozzle could be placed into and taken out of the cover stand for each use and then detachably attached for travel purposes if so desired.

This invention having been described in its presently contemplated best mode, it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An automatic dispensing apparatus comprising:

a resilient squeeze bottle and an automatic dispensing cap;

said resilient squeeze bottle having a squeeze bottle fastening device, a squeeze bottle neck, a squeeze bottle mouth, and, a squeeze bottle lip;

said resilient squeeze bottle having a liquid therein, or, a viscous fluid therein, or, a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein;

said automatic dispensing cap is securely attached to said resilient squeeze bottle;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is located entirely outside of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said automatic dispensing cap having automatic bi-directional dispensing features; said automatic dispensing cap having an automatic liquid or viscous fluid dispensing feature; and, an automatic air venting feature;

said cap body and said automatic valve are made of two different materials;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

2. The automatic dispensing apparatus of claim 1 wherein said automatic dispensing cap has means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

3. The automatic dispensing apparatus of claim 1 wherein said automatic valve is coupled across one side only of said aperture in said cap wall.

4. The automatic dispensing apparatus of claim 1 including means for coupling said automatic valve to said cap body.

5. The automatic dispensing apparatus of claim 1 wherein said automatic valve is integrally formed with said cap body.

6. The automatic dispensing apparatus of claim 1 wherein said automatic valve is integrally molded with said cap body.

7. The automatic dispensing apparatus of claim 1 wherein said dispensing cap has a spout, and said automatic valve is coupled to said spout;

or, said automatic valve is integrally formed to said spout;

or, said automatic valve is integrally molded to said spout;

or, said automatic valve is to bonded to said spout.

8. The automatic dispensing apparatus of claim 1 wherein the lip of said squeeze bottle has a lip inner diameter and said automatic valve has a valve diameter; and said valve diameter is smaller than said lip inner diameter of said squeeze bottle.

9. The automatic dispensing apparatus of claim 1 wherein there is a fluid tight seal between the lip of said squeeze bottle and said automatic dispensing cap;

or, said automatic dispensing cap has an integrally formed annular sealing element; and there is a fluid tight seal between said squeeze bottle and said integrally formed annular sealing element.

10. The automatic dispensing apparatus of claim 1 wherein said support base has substantially a round shape;

or, said resilient squeeze bottle has a cross sectional shape that is substantially round.

11. The automatic dispensing apparatus of claim 1 wherein said support base has a cross sectional area that is larger than the cross sectional area of the neck of said squeeze bottle;

or, said support base has a cross sectional area that is larger than the largest cross sectional area of said squeeze bottle.

12. The automatic dispensing apparatus of claim 1 wherein said dispensing cap has a squeeze bottle end and a support base end; and, said support base end of said dispensing cap has a larger cross sectional area than said squeeze bottle end of said dispensing cap.

13. The automatic dispensing apparatus of claim 1 wherein said squeeze bottle fastening device is squeeze bottle threads, and said cap fastening device is cap threads.

14. The automatic dispensing apparatus of claim 1 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

15. The automatic dispensing apparatus of claim 1 wherein said dispensing cap has an inner skirt and an outer skirt; and, cap threads are integrally formed on the inner surface of said inner skirt.

16. The automatic dispensing apparatus of claim 1 wherein an annular rim is integrally formed around a perimeter of said dispensing cap; and, said rim contacts said horizontal surface when said squeeze bottle is being stored in said dispensing cap down position on said horizontal surface.

17. The automatic dispensing apparatus of claim 1 wherein said dispensing cap has substantially a continuous seal between said dispensing cap and said horizontal surface when said squeeze bottle is being stored in said dispensing cap down position on said horizontal surface.

18. The automatic dispensing apparatus of claim 1 wherein said automatic valve is bonded to said cap body.

19. The automatic dispensing apparatus of claim 1 wherein said resilient squeeze bottle is made of a material that is translucent;

or, said squeeze bottle is made of a material that is opaque;

or, said squeeze bottle is made of a material that is colored.

20. The automatic dispensing apparatus of claim 1 wherein said automatic dispensing apparatus has a safety seal that provides evidence that a fluid has not been dispensed from said resilient squeeze bottle prior to a first use.

21. An automatic dispensing apparatus comprising:

a resilient squeeze bottle and an automatic dispensing cap;

said resilient squeeze bottle having a squeeze bottle fastening device, a squeeze bottle neck, a squeeze bottle mouth, and, a squeeze bottle lip;

said resilient squeeze bottle having said liquid therein, or, a viscous fluid therein, or, food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein;

said automatic dispensing cap is securely attached to said resilient squeeze bottle;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are made of two different materials;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

22. The automatic dispensing apparatus of claim 21 wherein said automatic dispensing cap has means for dispensing said fluid with one hand when said resilient squeeze bottle is stored in said dispensing cap down position on said horizontal surface;

whereby a fluid is dispensed with one hand by lifting and squeezing said resilient squeeze bottle with one hand.

23. The automatic dispensing apparatus of claim 21 wherein said automatic valve is located entirely outside said aperture.

24. The automatic dispensing apparatus of claim 21 including means for coupling said automatic valve to said cap body.

25. The automatic dispensing apparatus of claim 21 wherein said automatic valve is integrally formed with said cap body.

26. The automatic dispensing apparatus of claim 21 wherein said automatic valve is integrally molded with said cap body.

27. The automatic dispensing apparatus of claim 21 wherein said automatic dispensing cap has automatic bi-directional dispensing features; said automatic dispensing cap has an automatic liquid or viscous fluid dispensing feature; and, an automatic air venting feature.

28. The automatic dispensing apparatus of claim 21 wherein said automatic valve is coupled across said support base side of said aperture in said cap wall;

said automatic dispensing cap having means for coupling said automatic valve to said cap body;

or, said automatic valve is integrally formed with said cap body;

or, said automatic valve is integrally molded with said cap body;

or, said automatic valve is bonded with said cap body.

29. The automatic dispensing apparatus of claim 21 wherein said dispensing cap has a spout, and said automatic valve is coupled to said spout;

or said automatic valve is integrally formed to said spout;

or said automatic valve is integrally molded to said spout;

or said automatic valve is to bonded to said spout.

30. The automatic dispensing apparatus of claim 21 wherein the lip of said squeeze bottle has a lip inner diameter and said automatic valve has a valve diameter; and said valve diameter is smaller than said lip inner diameter of said squeeze bottle.

31. The automatic dispensing apparatus of claim 21 wherein there is a fluid tight seal between the lip of said squeeze bottle and said automatic dispensing cap;

or, said automatic dispensing cap has an integrally formed annular sealing element, and there is a fluid tight seal between said squeeze bottle and said integrally formed annular sealing element.

32. The automatic dispensing apparatus of claim 21 wherein said support base has substantially a round shape;

or, said resilient squeeze bottle has a cross sectional shape that is substantially round.

33. The automatic dispensing apparatus of claim 21 wherein said support base has a cross sectional area that is larger than the cross sectional area of the neck of said squeeze bottle;

or, said support base has a cross sectional area that is larger than the largest cross sectional area of said squeeze bottle.

34. The automatic dispensing apparatus of claim 21 wherein said dispensing cap has a squeeze bottle end and a support base end; and said support base end of said dispensing cap has a larger cross sectional area than said squeeze bottle end of said dispensing cap.

35. The automatic dispensing apparatus of claim 21 wherein said dispensing cap has substantially a continuous seal between said dispensing cap and said horizontal surface when said squeeze bottle is being stored in said dispensing cap down position on said horizontal surface.

36. The automatic dispensing apparatus of claim 21 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

37. The automatic dispensing apparatus of claim 21 wherein said dispensing cap has an inner skirt and an outer skirt; and, cap threads are integrally formed on the inner surface of said inner skirt.

38. The automatic dispensing apparatus of claim 21 wherein an annular rim is integrally formed around a perimeter of said dispensing cap; and said rim contacts said horizontal surface when said squeeze bottle is being stored in said dispensing cap down position on said horizontal surface.

39. The automatic dispensing apparatus of claim 21 wherein said automatic valve is bonded to said cap body.

40. The automatic dispensing apparatus of claim 21 wherein said resilient squeeze bottle is made of a material that is translucent;

or, said resilient squeeze bottle is made of a material that is opaque;

or, said resilient squeeze bottle is made of a material that is colored.

41. The automatic dispensing apparatus of claim 21 wherein said automatic dispensing apparatus has a safety seal that provides evidence that a fluid has not been dispensed from said resilient squeeze bottle prior to a first use.

42. An automatic dispensing cap for use with a resilient squeeze bottle; said squeeze bottle having a squeeze bottle fastening device, a squeeze bottle neck, a squeeze bottle mouth, and a squeeze bottle lip; said automatic dispensing cap comprising:

a cap body;

said cap body having a cap fastening device; said cap fastening device having means for attaching said cap body to said resilient squeeze bottle;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is located entirely outside of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said resilient squeeze bottle is stored in said dispensing cap down position on said horizontal surface.

43. The automatic dispensing cap of claim 42 wherein said automatic dispensing cap has means for dispensing a fluid with one hand when said resilient squeeze bottle is stored in said dispensing cap down position on said horizontal surface;

whereby said fluid is dispensed with one hand by lifting and squeezing said resilient squeeze bottle with one hand.

44. The automatic dispensing cap of claim 42 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

45. The automatic dispensing apparatus of claim 42 wherein said automatic dispensing cap has automatic bi-directional dispensing features; said automatic dispensing cap has an automatic liquid or viscous fluid dispensing feature; and, an automatic air venting feature.

46. The automatic dispensing cap of claim 42 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

47. The automatic dispensing cap of claim 42 wherein an annular rim is integrally formed around a perimeter of said dispensing cap; and said rim contacts said horizontal surface when said squeeze bottle is being stored in said dispensing cap down position on said horizontal surface;

or, said dispensing cap has substantially a continuous seal between said dispensing cap and said horizontal surface when said squeeze bottle is being stored in said dispensing cap down position on said horizontal surface;

or, said support base has a cross sectional area that is larger than the cross sectional area of the neck of said squeeze bottle, or, said support base has a cross sectional area that is larger than the largest cross sectional area of said squeeze bottle;

or, said dispensing cap has a squeeze bottle end and a support base end; and said support base end of said dispensing cap has a larger cross sectional area than said squeeze bottle end of said dispensing cap;

or, said automatic dispensing cap has an integrally formed annular sealing element, and there is a fluid tight seal between said squeeze bottle and said integrally formed annular sealing element when said squeeze bottle is securely fastened to said automatic dispensing cap;

or, said dispensing cap has substantially a frusto conical shape;

or, said support base has substantially a round shape;

or; said dispensing cap has an inner skirt and an outer skirt; and cap threads are integrally formed on the inner surface of said inner skirt.

48. An automatic dispensing cap for use with a resilient squeeze bottle; said squeeze bottle having a squeeze bottle fastening device, a squeeze bottle neck, a squeeze bottle mouth, and a squeeze bottle lip; said automatic dispensing cap comprising:

a cap body;

said cap body having a cap fastening device; said cap fastening device having means for attaching said cap body to said resilient squeeze bottle;

said automatic dispensing cap having a portion that is utilized as a support base when said resilient squeeze bottle is stored in a dispensing cap down position on a horizontal surface;

said support base having a cross sectional area that is larger than the cross sectional area of the neck of said squeeze bottle, or, said support base having a cross sectional area that is larger than the largest cross sectional area of said squeeze bottle;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said automatic dispensing cap having automatic bi-directional dispensing features; said automatic dispensing cap has an automatic liquid or viscous fluid dispensing feature; and, an automatic air venting feature;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said resilient squeeze bottle is stored in said dispensing cap down position on said horizontal surface.

49. The automatic dispensing cap of claim 48 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

50. The automatic dispensing cap of claim 48 wherein an annular rim is integrally formed around a perimeter of said dispensing cap; and said rim contacts said horizontal surface when said squeeze bottle is being stored in said dispensing cap down position on said horizontal surface;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said automatic dispensing cap has an integrally formed annular sealing element, and there is a fluid tight seal between said squeeze bottle and said integrally formed annular sealing element when said squeeze bottle is securely fastened to said automatic dispensing cap;

or, said dispensing cap has substantially a frusto conical shape;

or, said support base has substantially a round shape;

or; said dispensing cap has an inner skirt and an outer skirt;

and cap threads are integrally formed on the inner surface of said inner skirt.

51. The automatic dispensing cap of claim 48 including a resilient squeeze bottle;

said resilient squeeze bottle having a squeeze bottle fastening device, a squeeze bottle neck, a squeeze bottle mouth, and, a squeeze bottle lip;

said resilient squeeze bottle having a liquid therein, or, a viscous fluid therein, or, a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein.

52. The automatic dispensing apparatus of claim 51 wherein said resilient squeeze bottle is made of a material that is translucent;

or, said squeeze bottle is made of a material that is opaque;

or, said squeeze bottle is made of a material that is colored;

or, said automatic dispensing apparatus has a safety seal that provides evidence that a fluid has not been dispensed from said resilient squeeze bottle prior to a first use.

53. An automatic dispensing apparatus comprising:

a resilient squeeze bottle and an automatic dispensing cap;

said resilient squeeze bottle having a squeeze bottle fastening device, a squeeze bottle neck, a squeeze bottle mouth, and, a squeeze bottle lip;

said resilient squeeze bottle having a liquid therein, or, a viscous fluid therein, or, a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein;

said automatic dispensing cap is securely attached to said resilient squeeze bottle;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said automatic dispensing cap having automatic bi-directional dispensing features; said automatic dispensing cap has an automatic liquid or viscous fluid dispensing feature; and, an automatic air venting feature;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface;

said automatic dispensing cap having means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

54. The automatic dispensing apparatus of claim 53 including means for coupling said automatic valve to said cap body;

or, aid automatic valve is integrally formed with said cap body;

or, said automatic valve is integrally molded with said cap body;

or, said automatic valve is bonded to said cap body;

or, said valve is located entirely outside of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

55. The automatic dispensing cap of claim 53 wherein an annular rim is integrally formed around a perimeter of said dispensing cap; and said rim contacts said horizontal surface when said squeeze bottle is being stored in said dispensing cap down position on said horizontal surface;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said automatic dispensing cap has an integrally formed annular sealing element, and there is a fluid tight seal between said squeeze bottle and said integrally formed annular sealing element when said squeeze bottle is securely fastened to said automatic dispensing cap;

or, said dispensing cap has substantially a frusto conical shape;

or, said support base has substantially a round shape;

or; said dispensing cap has an inner skirt and an outer skirt;

and cap threads are integrally formed on the inner surface of said inner skirt.

56. The automatic dispensing apparatus of claim 53 wherein said resilient squeeze bottle is made of a material that is translucent;

or, said resilient squeeze bottle is made of a material that is opaque;

or, said resilient squeeze bottle is made of a material that is colored;

or, said automatic dispensing apparatus has a safety seal that provides evidence that a fluid has not been dispensed from said resilient squeeze bottle prior to a first use.

57. An automatic dispensing cap for use with a resilient squeeze bottle; said squeeze bottle having a squeeze bottle fastening device, a squeeze bottle neck, a squeeze bottle mouth, and a squeeze bottle lip; said automatic dispensing cap comprising:

a cap body;

said cap body having a cap fastening device; said cap fastening device having means for attaching said cap body to said resilient squeeze bottle;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said automatic dispensing cap having automatic bi-directional dispensing features; said automatic dispensing cap having an automatic liquid or viscous fluid dispensing feature; and, an automatic air venting feature;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said resilient squeeze bottle is stored in said dispensing cap down position on said horizontal surface;

said automatic dispensing cap having means for dispensing a fluid with one hand when said resilient squeeze bottle is stored in said dispensing cap down position on said horizontal surface;

whereby said fluid is dispensed with one hand by lifting and squeezing said resilient squeeze bottle with one hand.

58. The automatic dispensing cap of claim 57 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is bonded to said cap body;

or, said valve is located entirely outside of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

59. The automatic dispensing cap of claim 57 wherein an annular rim is integrally formed around a perimeter of said dispensing cap; and said rim contacts said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a continuous seal between said dispensing cap and said horizontal surface when said squeeze bottle is being stored in said dispensing cap down position on said horizontal surface;

or, said support base has a cross sectional area that is larger than the cross sectional area of the neck of said squeeze bottle, or, said support base has a cross sectional area that is larger than the largest cross sectional area of said squeeze bottle;

or, said automatic dispensing cap has an integrally formed annular sealing element, and there is a fluid tight seal between said squeeze bottle and said integrally formed annular sealing element when said squeeze bottle is securely fastened to said automatic dispensing cap;

or, said support base has substantially a round shape;

or; said dispensing cap has an inner skirt and an outer skirt;

and cap threads are integrally formed on the inner surface of said inner skirt.

60. An automatic dispensing apparatus comprising:

a resilient squeeze bottle and an automatic dispensing cap;

said resilient squeeze bottle having squeeze bottle threads, a squeeze bottle neck, a squeeze bottle mouth, and, a squeeze bottle lip;

said resilient squeeze bottle having a liquid therein, or, a viscous fluid therein, or, a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein;

said automatic dispensing cap is securely attached to said resilient squeeze bottle;

said automatic dispensing cap having a cap body;

said cap body having cap threads; said cap threads engage said squeeze bottle threads;

said automatic dispensing cap having a portion that is utilized as a support base when said resilient squeeze bottle is stored in a dispensing cap down position on a horizontal surface;

said support base having a cross sectional area that is larger than the cross sectional area of the neck of said squeeze bottle; or, said support base having a cross sectional area that is larger than the largest cross sectional area of said squeeze bottle;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said automatic dispensing cap having automatic bi-directional dispensing features; said automatic dispensing cap has an automatic liquid or viscous fluid dispensing feature; and, an automatic air venting feature;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

61. The automatic dispensing apparatus of claim 60 including means for coupling said automatic valve to said cap body;

or, aid automatic valve is integrally formed with said cap body;

or, said automatic valve is integrally molded with said cap body;

or, said automatic valve is bonded to said cap body;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve is bonded to said cap body;

or, said valve is located entirely outside of said aperture in said cap wall;

or, said automatic valve coupled across said support base side of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout;

or, said automatic dispensing cap has automatic bi-directional dispensing features; said automatic dispensing cap has an automatic liquid or viscous fluid dispensing feature; and, an automatic air venting feature.

62. The automatic dispensing apparatus of claim 60 wherein an annular rim is integrally formed around a perimeter of said dispensing cap; and said rim contacts said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a continuous seal between said dispensing cap and said horizontal surface when said squeeze bottle is being stored in said dispensing cap down position on said horizontal surface;

or, there is a fluid tight seal between the neck of said squeeze bottle and said dispensing cap;

or, said dispensing cap has substantially a frusto conical shape;

or, said support base has substantially a round shape;

or; said dispensing cap has an inner skirt and an outer skirt;

and said cap threads are integrally formed on the inner surface of said inner skirt.

63. The automatic dispensing apparatus of claim 60 wherein said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

64. The automatic dispensing apparatus of claim 60 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

65. The automatic dispensing apparatus of claim 60 wherein said resilient squeeze bottle is made of a material that is translucent;

or, said resilient squeeze bottle is made of a material that is opaque;

or, said resilient squeeze bottle is made of a material that is colored.

66. The automatic dispensing apparatus of claim 60 said automatic dispensing apparatus has a safety seal that provides evidence that a fluid has not been dispensed from said resilient squeeze bottle prior to a first use.

67. An automatic dispensing cap for use with a resilient squeeze bottle; said squeeze bottle having squeeze bottle threads, a squeeze bottle neck, a squeeze bottle mouth, and a squeeze bottle lip; said automatic dispensing cap comprising:

a cap body;

said cap body having cap threads; said cap threads having means for attaching said cap body to said resilient squeeze bottle;

said automatic dispensing cap having a portion that is utilized as a support base when said resilient squeeze bottle is stored in a dispensing cap down position on a horizontal surface;

said support base having a cross sectional area that is larger than the cross sectional area of the neck of said squeeze bottle;

or, said support base having a cross sectional area that is larger than the largest cross sectional area of said squeeze bottle;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said resilient squeeze bottle is stored in said dispensing cap down position on said horizontal surface.

68. The automatic dispensing cap of claim 57 including means for coupling said automatic valve to said cap body;

or, aid automatic valve is integrally formed with said cap body;

or, said automatic valve is integrally molded with said cap body;

or, said automatic valve is bonded to said cap body;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve is bonded to said cap body;

or, said valve is located entirely outside of said aperture in said cap wall;

or, said automatic valve coupled across said support base side of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout;

or, said automatic dispensing cap has automatic bi-directional dispensing features; said automatic dispensing cap has an automatic liquid or viscous fluid dispensing feature; and, an automatic air venting feature.

69. The automatic dispensing cap of claim 67 wherein said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

70. The automatic dispensing cap of claim 67 wherein said cap threads have a diameter of substantially 33 millimeters (substantially 1.31 inches).

71. The automatic dispensing cap of claim 67 wherein said cap threads have a diameter of substantially 38 millimeters (substantially 1.43 inches).

72. The automatic dispensing cap of claim 67 wherein an annular rim is integrally formed around a perimeter of said dispensing cap; and said rim contacts said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a continuous seal between said dispensing cap and said horizontal surface when said squeeze bottle is being stored in said dispensing cap down position on said horizontal surface;

or, there is a fluid tight seal between the neck of said squeeze bottle and said dispensing cap;

or, said dispensing cap has substantially a frusto conical shape;

or, said support base has substantially a round shape;

or; said dispensing cap has an inner skirt and an outer skirt;

and said cap threads are integrally formed on the inner surface of said inner skirt.

73. The automatic dispensing cap of claim 67 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

74. An automatic dispensing apparatus comprising:

a resilient squeeze bottle and an automatic dispensing cap;

said squeeze bottle having squeeze bottle threads, a squeeze bottle neck, a squeeze bottle mouth, and, a squeeze bottle lip;

said resilient squeeze bottle having a liquid therein, or, a viscous fluid therein, or, a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein;

said automatic dispensing cap is securely attached to said resilient squeeze bottle;

said automatic dispensing cap having a cap body;

said cap body having cap threads; said cap threads engage said squeeze bottle threads;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface;

said automatic dispensing cap having means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

75. The automatic dispensing apparatus of claim 74 including means for coupling said automatic valve to said cap body;

or, aid automatic valve is integrally formed with said cap body;

or, said automatic valve is integrally molded with said cap body;

or, said automatic valve is bonded to said cap body;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve is bonded to said cap body;

or, said valve is located entirely outside of said aperture in said cap wall;

or, said automatic valve coupled across said support base side of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout;

or, said automatic dispensing cap has automatic bi-directional dispensing features; said automatic dispensing cap has an automatic liquid or viscous fluid dispensing feature; and, an automatic air venting feature.

76. The automatic dispensing apparatus of claim 74 wherein said cap threads have any diameter;

or, said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches);

or, said cap threads any diameter between 24 millimeters (substantially 0.937 inches) and 38 millimeters (substantially 1.43 inches).

77. The automatic dispensing apparatus of claim 74 wherein said cap threads have a diameter of substantially 33 millimeters (substantially 1.31 inches).

78. The automatic dispensing apparatus of claim 74 wherein said cap threads have a diameter of substantially 38 millimeters (substantially 1.43 inches).

79. The automatic dispensing apparatus of claim 74 wherein an annular rim is integrally formed around a perimeter of said dispensing cap; and said rim contacts said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a continuous seal between said dispensing cap and said horizontal surface when said squeeze bottle is being stored in said dispensing cap down position on said horizontal surface;

or, said support base has a cross sectional area that is larger than the cross sectional area of the neck of said squeeze bottle, or, said support base has a cross sectional area that is larger than the largest cross sectional area of said squeeze bottle, or, said support base has any cross sectional area therebetween;

or, there is a fluid tight seal between the neck of said squeeze bottle and said dispensing cap;

or, said automatic dispensing cap has an integrally formed annular sealing element, and there is a fluid tight seal between said squeeze bottle and said integrally formed annular sealing element;

or, said dispensing cap has substantially a frusto conical shape;

or, said support base has substantially a round shape;

or; said dispensing cap has an inner skirt and an outer skirt; and cap threads are integrally formed on the inner surface of said inner skirt.

80. The automatic dispensing apparatus of claim 74 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

81. The automatic dispensing apparatus of claim 74 wherein said resilient squeeze bottle is made of a material that is translucent;

or, said resilient squeeze bottle is made of a material that is opaque;

or, said resilient squeeze bottle is made of a material that is colored.

82. The automatic dispensing apparatus of claim 74 wherein said automatic dispensing apparatus has a safety seal that provides evidence that a fluid has not been dispensed from said resilient squeeze bottle prior to a first use.

83. An automatic dispensing cap for use with a resilient squeeze bottle; said squeeze bottle having a squeeze bottle fastening device, a squeeze bottle neck, a squeeze bottle mouth, and a squeeze bottle lip; said automatic dispensing cap comprising:

a cap body;

said cap body having a cap fastening device; said cap fastening device having means for attaching said cap body to said resilient squeeze bottle;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said resilient squeeze bottle is stored in said dispensing cap down position on said horizontal surface;

said automatic dispensing cap having means for dispensing a fluid with one hand when said resilient squeeze bottle is stored in said dispensing cap down position on said horizontal surface;

whereby said fluid is dispensed with one hand by lifting and squeezing said resilient squeeze bottle with one hand.

84. The automatic dispensing cap of claim 83 including means for coupling said automatic valve to said cap body;

or, aid automatic valve is integrally formed with said cap body;

or, said automatic valve is integrally molded with said cap body;

or, said automatic valve is bonded to said cap body;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve is bonded to said cap body;

or, said valve is located entirely outside of said aperture in said cap wall;

or, said automatic valve coupled across said support base side of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout;

or, said automatic dispensing cap has automatic bi-directional dispensing features; said automatic dispensing cap has an automatic liquid or viscous fluid dispensing feature; and, an automatic air venting feature.

85. The automatic dispensing cap of claim 83 wherein said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

86. The automatic dispensing cap apparatus of claim 83 wherein said cap threads have a diameter of substantially 33 millimeters (substantially 1.31 inches).

87. The automatic dispensing cap of claim 83 wherein said cap threads have a diameter of substantially 38 millimeters (substantially 1.43 inches).

88. The automatic dispensing cap of claim 83 wherein an annular rim is integrally formed around a perimeter of said dispensing cap; and said rim contacts said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a continuous seal between said dispensing cap and said horizontal surface when said squeeze bottle is being stored in said dispensing cap down position on said horizontal surface;

or, said support base has a cross sectional area that is larger than the cross sectional area of the neck of said squeeze bottle, or, said support base has a cross sectional area that is larger than the largest cross sectional area of said squeeze bottle;

or, there is a fluid tight seal between the neck of said squeeze bottle and said dispensing cap;

or, said automatic dispensing cap has an integrally formed annular sealing element, and there is a fluid tight seal between said squeeze bottle and said integrally formed annular sealing element;

or, said dispensing cap has substantially a frusto conical shape;

or, said support base has substantially a round shape;

or; said dispensing cap has an inner skirt and an outer skirt;

and cap threads are integrally formed on the inner surface of said inner skirt;

or, there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

89. An automatic dispensing cap for use with a resilient squeeze bottle; said squeeze bottle having a squeeze bottle fastening device, a squeeze bottle neck, a squeeze bottle mouth, and a squeeze bottle lip; said automatic dispensing cap comprising:

a cap body;

said cap body having a cap fastening device; said cap fastening device having means for attaching said cap body to said resilient squeeze bottle;

said automatic dispensing cap having a portion that is utilized as a support base when said resilient squeeze bottle is stored in a dispensing cap down position on a horizontal surface;

said dispensing cap has a squeeze bottle end and a support base end; said support base end of said dispensing cap having a larger cross sectional area than said squeeze bottle end of said dispensing cap;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said resilient squeeze bottle is stored in said dispensing cap down position on said horizontal surface.

90. The automatic dispensing cap of claim 89 wherein said automatic dispensing cap has means for dispensing a fluid with one hand when said resilient squeeze bottle is stored in said dispensing cap down position on said horizontal surface;

whereby said fluid is dispensed with one hand by lifting and squeezing said resilient squeeze bottle with one hand.

91. The automatic dispensing cap of claim 89 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

92. The automatic dispensing cap of claim 89 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has substantially a frusto conical shape;

or, said support base has substantially a round shape;

or; said dispensing cap has an inner skirt and an outer skirt;

and cap threads are integrally formed on the inner surface of said inner skirt.

93. The automatic dispensing cap of claim 89 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

94. The automatic dispensing cap of claim 89 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

95. The automatic dispensing cap of claim 89 including a resilient squeeze bottle;

said resilient squeeze bottle having a squeeze bottle fastening device, a squeeze bottle neck, a squeeze bottle mouth, and, a squeeze bottle lip;

said resilient squeeze bottle having a liquid therein, or, a viscous fluid therein, or, a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein.

96. The automatic dispensing apparatus of claim 95 wherein said resilient squeeze bottle is made of a material that is translucent;

or, said resilient squeeze bottle is made of a material that is opaque;

or, said resilient squeeze bottle is made of a material that is colored.

97. The automatic dispensing apparatus of claim 95 wherein said automatic dispensing apparatus has a safety seal that provides evidence that a fluid has not been dispensed from said resilient squeeze bottle prior to a first use.

98. An automatic dispensing apparatus comprising:

a resilient squeeze bottle and an automatic dispensing cap;

said resilient squeeze bottle having a squeeze bottle fastening device, a squeeze bottle neck, a squeeze bottle mouth, and, a squeeze bottle lip;

said resilient squeeze bottle having a liquid therein, or, a viscous fluid therein, or, a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein;

said automatic dispensing cap is securely fastened to said squeeze bottle;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across said support base side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

99. The automatic dispensing apparatus of claim 98 wherein said automatic dispensing cap has means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

100. The automatic dispensing apparatus of claim 98 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

101. The automatic dispensing apparatus cap of claim 98 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has substantially a frusto conical shape;

or, said support base has substantially a round shape;

or; said dispensing cap has an inner skirt and an outer skirt;

and cap threads are integrally formed on the inner surface of said inner skirt.

102. The automatic dispensing apparatus of claim 98 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

103. The automatic dispensing apparatus of claim 98 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

104. The automatic dispensing apparatus of claim 98 wherein said resilient squeeze bottle is made of a material that is translucent;

or, said resilient squeeze bottle is made of a material that is opaque;

or, said resilient squeeze bottle is made of a material that is colored;

or, wherein said automatic dispensing apparatus has a safety seal that provides evidence that a fluid has not been dispensed from said resilient squeeze bottle prior to a first use.

105. An automatic dispensing cap for use with a resilient squeeze bottle; said squeeze bottle having a squeeze bottle fastening device, a squeeze bottle neck, a squeeze bottle mouth, and a squeeze bottle lip; said automatic dispensing cap comprising:

a cap body;

said cap body having a cap fastening device; said cap fastening device having means for attaching said cap body to said resilient squeeze bottle;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across said support base side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said resilient squeeze bottle is stored in said dispensing cap down position on said horizontal surface.

106. The automatic dispensing cap of claim 105 wherein said automatic dispensing cap has means for dispensing a fluid with one hand when said resilient squeeze bottle is stored in said dispensing cap down position on said horizontal surface;

whereby said fluid is dispensed with one hand by lifting and squeezing said resilient squeeze bottle with one hand.

107. The automatic dispensing cap of claim 105 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

108. The automatic dispensing cap of claim 105 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has substantially a frusto conical shape;

or, said support base has substantially a round shape;

or; said dispensing cap has an inner skirt and an outer skirt; and cap threads are integrally formed on the inner surface of said inner skirt.

109. The automatic dispensing cap of claim 105 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

110. The automatic dispensing cap of claim 105 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

111. An automatic dispensing apparatus comprising:

a resilient squeeze bottle and an automatic dispensing cap;

said squeeze bottle having a squeeze bottle fastening device, a squeeze bottle neck, and, a squeeze bottle lip;

said resilient squeeze bottle having a viscous fluid therein, or, a food product therein, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein;

said automatic dispensing cap is securely attached to said resilient squeeze bottle;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

an annular rim is integrally formed around a perimeter of said dispensing cap; and said rim contacts said horizontal surface when said squeeze bottle is being stored in said dispensing cap down position on said horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

112. The automatic dispensing apparatus of claim 111 wherein said automatic dispensing cap has means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

113. The automatic dispensing apparatus of claim 111 including means for coupling said automatic valve to said cap body;

or, aid automatic valve is integrally formed with said cap body;

or, said automatic valve is integrally molded with said cap body;

or, said automatic valve is bonded to said cap body;

or, said valve is coupled across one side only of said aperture in said cap wall;

or, said automatic valve is located entirely outside of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

114. The automatic dispensing apparatus of claim 111 wherein said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has substantially a frusto conical shape;

or, said support base has substantially a round shape;

or; said dispensing cap has an inner skirt and an outer skirt; and cap threads are integrally formed on the inner surface of said inner skirt.

115. The automatic dispensing apparatus of claim 111 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

116. The automatic dispensing apparatus of claim 111 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

117. The automatic dispensing apparatus of claim 111 wherein said resilient squeeze bottle is made of a material that is translucent;

or, said resilient squeeze bottle is made of a material that is opaque;

or, said resilient squeeze bottle is made of a material that is colored.

118. The automatic dispensing apparatus of claim 111 wherein said automatic dispensing apparatus has a safety seal that provides evidence that a fluid has not been dispensed from said resilient squeeze bottle prior to a first use.

119. An automatic dispensing cap for use with a resilient squeeze bottle; said squeeze bottle having a squeeze bottle fastening device, a squeeze bottle neck, a squeeze bottle mouth, and a squeeze bottle lip; said automatic dispensing cap comprising:

a cap body;

said cap body having a cap fastening device; said cap fastening device having means for attaching said cap body to said resilient squeeze bottle;

said automatic dispensing cap having a portion that is utilized as a support base when said resilient squeeze bottle is stored in a dispensing cap down position on a horizontal surface;

an annular rim is integrally formed around a perimeter of said dispensing cap; and said rim contacts said horizontal surface when said squeeze bottle is being stored in said dispensing cap down position on said horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said resilient squeeze bottle is stored in said dispensing cap down position on said horizontal surface.

120. The automatic dispensing cap of claim 119 wherein said automatic dispensing cap has means for dispensing a fluid with one hand when said resilient squeeze bottle is stored in said dispensing cap down position on said horizontal surface;

whereby said fluid is dispensed with one hand by lifting and squeezing said resilient squeeze bottle with one hand.

121. The automatic dispensing cap of claim 119 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

122. The automatic dispensing cap of claim 119 said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has substantially a frusto conical shape;

or, said support base has substantially a round shape;

or; said dispensing cap has an inner skirt and an outer skirt;

and cap threads are integrally formed on the inner surface of said inner skirt.

123. The automatic dispensing cap of claim 119 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

124. The automatic dispensing cap of claim 119 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

125. An automatic dispensing apparatus comprising:

a resilient squeeze bottle and an automatic dispensing cap;

said resilient squeeze bottle having a squeeze bottle fastening device, a squeeze bottle neck, and, a squeeze bottle lip;

said resilient squeeze bottle having a viscous fluid therein, or, a food product therein, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein;

said automatic dispensing cap is securely attached to said resilient squeeze bottle;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said dispensing cap has substantially a continuous seal with said horizontal surface when said squeeze bottle is being stored in said dispensing cap down position on said horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

126. The automatic dispensing apparatus of claim 125 wherein said automatic dispensing cap has means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

127. The automatic dispensing apparatus of claim 125 including means for coupling said automatic valve to said cap body;

or, aid automatic valve is integrally formed with said cap body;

or, said automatic valve is integrally molded with said cap body;

or, said automatic valve is bonded to said cap body;

or, said valve is coupled across one side only of said aperture in said cap wall;

or, said automatic valve is located entirely outside of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

128. The automatic dispensing apparatus of claim 125 wherein said support base has a cross sectional area that is larger than the cross sectional area of the neck of said squeeze bottle; or, said support base has a cross sectional area that is larger than the largest cross sectional area of said squeeze bottle;

or, said dispensing cap has substantially a frusto conical shape;

or, said support base has substantially a round shape;

or; said dispensing cap has an inner skirt and an outer skirt; and cap threads are integrally formed on the inner surface of said inner skirt.

129. The automatic dispensing apparatus of claim 125 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

130. The automatic dispensing apparatus of claim 125 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

131. The automatic dispensing apparatus of claim 125 wherein said resilient squeeze bottle is made of a material that is translucent;

or, said resilient squeeze bottle is made of a material that is opaque;

or, said resilient squeeze bottle is made of a material that is colored;

or, wherein said automatic dispensing apparatus has a safety seal that provides evidence that a fluid has not been dispensed from said resilient squeeze bottle prior to a first use.

132. An automatic dispensing apparatus comprising:

a resilient squeeze bottle and an automatic dispensing cap;

said resilient squeeze bottle having squeeze bottle threads, a squeeze bottle neck, and, a squeeze bottle lip;

said resilient squeeze bottle having a liquid therein, or, a viscous fluid therein, or, a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein;

said automatic dispensing cap is securely attached to said resilient squeeze bottle;

said automatic dispensing cap having a cap body;

said cap body having an inner skirt and an outer skirt; and cap threads are integrally formed on the inner surface of said inner skirt;

said cap threads engage said squeeze bottle threads;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

133. The automatic dispensing apparatus of claim 132 wherein said automatic dispensing cap has means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

134. The automatic dispensing apparatus of claim 132 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

135. The automatic dispensing apparatus of claim 132 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt;

and cap threads are integrally formed on the inner surface of said inner skirt.

136. The automatic dispensing apparatus of claim 132 wherein said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

137. The automatic dispensing apparatus of claim 132 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

138. The automatic dispensing apparatus of claim 132 wherein said resilient squeeze bottle is made of a material that is translucent;

or, said resilient squeeze bottle is made of a material that is opaque;

or, said resilient squeeze bottle is made of a material that is colored.

139. The automatic dispensing apparatus of claim 132 wherein said automatic dispensing apparatus has a safety seal that provides evidence that a fluid has not been dispensed from said resilient squeeze bottle prior to a first use.

140. An automatic dispensing apparatus comprising:

a resilient squeeze bottle and an automatic dispensing cap;

said resilient squeeze bottle having a squeeze bottle fastening device, a squeeze bottle neck, a squeeze bottle mouth, and, a squeeze bottle lip;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein;

said automatic dispensing cap is securely attached to said resilient squeeze bottle;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

141. The automatic dispensing apparatus of claim 140 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said valve is coupled across one side only of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

142. The automatic dispensing apparatus of claim 140 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt, and cap fastening device is integrally formed on the inner surface of said inner skirt.

143. The automatic dispensing apparatus of claim 140 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

144. The automatic dispensing apparatus of claim 140 wherein said resilient squeeze bottle is made of a material that is translucent;

or, said resilient squeeze bottle is made of a material that is opaque;

or, said resilient squeeze bottle is made of a material that is colored;

or, wherein said automatic dispensing apparatus has a safety seal that provides evidence that a fluid has not been dispensed from said resilient squeeze bottle prior to a first use.

145. An automatic dispensing apparatus comprising:

a resilient squeeze bottle and an automatic dispensing cap;

said resilient squeeze bottle having a squeeze bottle fastening device, a squeeze bottle neck, a squeeze bottle mouth, and, a squeeze bottle lip;

said resilient squeeze bottle is made of a material that is translucent; or, said resilient squeeze bottle is made of a material that is opaque; or, said resilient squeeze bottle is made of a material that is colored;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein;

said automatic dispensing cap is securely attached to said resilient squeeze bottle;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

146. The automatic dispensing apparatus of claim 145 wherein said automatic dispensing cap has means for dispensing said food fluid with one hand when said resilient squeeze bottle is stored in said dispensing cap down position on said horizontal surface;

whereby said food fluid is dispensed with one hand by lifting and squeezing said resilient squeeze bottle with one hand.

147. The automatic dispensing apparatus of claim 145 including means for coupling said automatic valve to said cap body;

or, aid automatic valve is integrally formed with said cap body;

or, said automatic valve is integrally molded with said cap body;

or, said automatic valve is bonded to said cap body;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said valve is coupled across one side only of said aperture in said cap wall;

or, said valve is located entirely outside of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

148. The automatic dispensing apparatus of claim 145 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt; and cap fastening device is integrally formed on the inner surface of said inner skirt.

149. The automatic dispensing apparatus of claim 145 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

150. The automatic dispensing apparatus of claim 145 wherein said automatic dispensing apparatus has a safety seal that provides evidence that a fluid has not been dispensed from said resilient squeeze bottle prior to a first use.

151. An automatic dispensing apparatus comprising:

a resilient squeeze bottle and an automatic dispensing cap;

said resilient squeeze bottle having a squeeze bottle fastening device, a squeeze bottle neck, a squeeze bottle mouth, and, a squeeze bottle lip;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein;

said automatic dispensing cap is securely attached to said resilient squeeze bottle;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body;

said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface;

said dispensing apparatus having a safety seal that provides evidence that a fluid has not been dispensed from said resilient squeeze bottle prior to a first use.

152. The automatic dispensing apparatus of claim 151 including means for coupling said automatic valve to said cap body;

or, aid automatic valve is integrally formed with said cap body;

or, said automatic valve is integrally molded with said cap body;

or, said automatic valve is bonded to said cap body;

or, said valve is coupled across one side only of said aperture in said cap wall;

or, said valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

153. The automatic dispensing apparatus map of claim 151 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt, and cap fastening device is integrally formed on the inner surface of said inner skirt.

154. The automatic dispensing apparatus of claim 151 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

155. The automatic dispensing apparatus of claim 151 wherein said resilient squeeze bottle is made of a material that is translucent;

or, said resilient squeeze bottle is made of a material that is opaque;

or, said resilient squeeze bottle is made of a material that is colored.

156. An automatic dispensing apparatus comprising:

a resilient squeeze bottle and an automatic dispensing cap;

said resilient squeeze bottle having a squeeze bottle fastening device, a squeeze bottle neck, a squeeze bottle mouth, and, a squeeze bottle lip;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein;

said automatic dispensing cap is securely attached to said resilient squeeze bottle;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface;

said automatic dispensing cap having means for dispensing said food fluid with one hand when said resilient squeeze bottle is stored in said dispensing cap down position on said horizontal surface;

whereby said food fluid is dispensed with one hand by lifting and squeezing said resilient squeeze bottle with one hand.

157. The automatic dispensing apparatus of claim 156 including means for coupling said automatic valve to said cap body;

or, aid automatic valve is integrally formed with said cap body;

or, said automatic valve is integrally molded with said cap body;

or, said automatic valve is bonded to said cap body;

or, said valve is coupled across one side only of said aperture in said cap wall;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing'cap has a spout; and said automatic valve is coupled to said spout;

or, said automatic valve is integrally formed to said spout;

or, said automatic valve is integrally molded to said spout;

or, said automatic valve is to bonded to said spout.

158. The automatic dispensing apparatus of claim 156 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt;

and cap fastening device is integrally formed on the inner surface of said inner skirt.

159. The automatic dispensing apparatus of claim 156 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

160. The automatic dispensing apparatus of claim 156 wherein said resilient squeeze bottle is made of a material that is translucent;

or, said resilient squeeze bottle is made of a material that is opaque;

or, said resilient squeeze bottle is made of a material that is colored.

161. The automatic dispensing apparatus of claim 156 wherein said automatic dispensing apparatus has a safety seal that provides evidence that a fluid has not been dispensed from said resilient squeeze bottle prior to a first use.

162. An automatic dispensing apparatus comprising:

a resilient squeeze bottle and an automatic dispensing cap;

said resilient squeeze bottle having a squeeze bottle fastening device, a squeeze bottle neck, a squeeze bottle mouth, and, a squeeze bottle lip;

said resilient squeeze bottle having a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein;

said resilient squeeze bottle having a squeeze bottle top and a squeeze bottle bottom;

said squeeze bottle top having means for preventing said squeeze bottle from being stored on said squeeze bottle top; and said automatic dispensing cap is securely attached to said resilient squeeze bottle bottom;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

163. The automatic dispensing apparatus of claim 162 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

164. The automatic dispensing apparatus of claim 162 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

165. The automatic dispensing apparatus of claim 162 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt, and cap fastening device is integrally formed on the inner surface of said inner skirt.

166. The automatic dispensing apparatus of claim 162 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

167. The automatic dispensing apparatus of claim 162 wherein said resilient squeeze bottle is made of a material that is translucent;

or, said resilient squeeze bottle is made of a material that is opaque;

or, said resilient squeeze bottle is made of a material that is colored;

or, wherein said automatic dispensing apparatus has a safety seal that provides evidence that a fluid has not been dispensed from said resilient squeeze bottle prior to a first use.

168. An automatic dispensing apparatus comprising:

a resilient squeeze bottle and an automatic dispensing cap;

said resilient squeeze bottle having a squeeze bottle fastening device, a squeeze bottle neck, a squeeze bottle mouth, and, a squeeze bottle lip;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein, said resilient squeeze bottle having a squeeze bottle top and a squeeze bottle bottom;

said squeeze bottle top having means for preventing said squeeze bottle from being stored on said squeeze bottle top; and said automatic dispensing cap is securely attached to said resilient squeeze bottle bottom;

said automatic dispensing cap having a cap body;

said cap body having a cap fastening device; said cap fastening device engages said squeeze bottle fastening device;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface;

said automatic dispensing cap having means for dispensing said food fluid with one hand when said resilient squeeze bottle is stored in said dispensing cap down position on said horizontal surface;

whereby said food fluid is dispensed with one hand by lifting and squeezing said resilient squeeze bottle with one hand.

169. The automatic dispensing apparatus of claim 168 including means for coupling said automatic valve to said cap body;

or, aid automatic valve is integrally formed with said cap body;

or, said automatic valve is integrally molded with said cap body;

or, said automatic valve is bonded to said cap body;

or, said valve is coupled across one side only of said aperture in said cap wall;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

170. The automatic dispensing apparatus of claim 168 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

171. The automatic dispensing apparatus of claim 168 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt, and cap fastening device is integrally formed on the inner surface of said inner skirt.

172. The automatic dispensing apparatus of claim 168 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

173. The automatic dispensing apparatus of claim 168 wherein said resilient squeeze bottle is made of a material that is translucent;

or, said resilient squeeze bottle is made of a material that is opaque;

or, said resilient squeeze bottle is made of a material that is colored;

or, wherein said automatic dispensing apparatus has a safety seal that provides evidence that a fluid has not been dispensed from said resilient squeeze bottle prior to a first use.

174. An automatic dispensing apparatus comprising:

a resilient squeeze bottle and an automatic dispensing cap;

said resilient squeeze bottle having squeeze bottle threads, a squeeze bottle neck, a squeeze bottle mouth, and, a squeeze bottle lip;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein;

said automatic dispensing cap is securely attached to said resilient squeeze bottle;

said automatic dispensing cap having a cap body;

said cap body having cap threads; said cap threads engage said squeeze bottle threads;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

175. The automatic dispensing apparatus of claim 174 including means for coupling said automatic valve to said cap body;

or, aid automatic valve is integrally formed with said cap body;

or, said automatic valve is integrally molded with said cap body;

or, said automatic valve is bonded to said cap body;

or, said valve is coupled across one side only of said aperture in said cap wall;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic, liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

176. The automatic dispensing apparatus of claim 174 wherein said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

177. The automatic dispensing apparatus of claim 174 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt, and cap fastening device is integrally formed on the inner surface of said inner skirt.

178. The automatic dispensing apparatus of claim 174 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

179. The automatic dispensing apparatus of claim 174 wherein said resilient squeeze bottle is made of a material that is translucent;

or, said resilient squeeze bottle is made of a material that is opaque;

or, said resilient squeeze bottle is made of a material that is colored;

or, wherein said automatic dispensing apparatus has a safety seal that provides evidence that a fluid has not been dispensed from said resilient squeeze bottle prior to a first use.

180. An automatic dispensing apparatus comprising:

a resilient squeeze bottle and an automatic dispensing cap;

said resilient squeeze bottle having squeeze bottle threads, a squeeze bottle neck, a squeeze bottle mouth, and, a squeeze bottle lip;

said resilient squeeze bottle is made of a material that is translucent; or, said resilient squeeze bottle is made of a material that is opaque; or, said resilient squeeze bottle is made of a material that is colored;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein;

said automatic dispensing cap is securely attached to said resilient squeeze bottle;

said automatic dispensing cap having a cap body;

said cap body having cap threads; said cap threads engage said squeeze bottle threads;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

181. The automatic dispensing apparatus of claim 180 wherein said automatic dispensing cap has means for dispensing said food fluid with one hand when said resilient squeeze bottle is stored in said dispensing cap down position on said horizontal surface;

whereby said food fluid is dispensed with one hand by lifting and squeezing said resilient squeeze bottle with one hand.

182. The automatic dispensing apparatus of claim 180 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said valve is coupled across one side only of said aperture in said cap wall;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

183. The automatic dispensing apparatus of claim 180 wherein said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

184. The automatic dispensing apparatus of claim 180 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt, and cap fastening device is integrally formed on the inner surface of said inner skirt.

185. The automatic dispensing apparatus of claim 180 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

186. The automatic dispensing apparatus of claim 180 wherein said dispensing apparatus has a safety seal that provides evidence that a fluid has not been dispensed from said resilient squeeze bottle prior to a first use.

187. An automatic dispensing apparatus comprising:

a resilient squeeze bottle and an automatic dispensing cap;

said resilient squeeze bottle having squeeze bottle threads, a squeeze bottle neck, a squeeze bottle mouth, and, a squeeze bottle lip;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein;

said automatic dispensing cap is securely attached to said resilient squeeze bottle;

said automatic dispensing cap having a cap body;

said cap body having cap threads; said cap threads engage said squeeze bottle threads;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface;

said automatic dispensing apparatus having a safety seal that provides evidence that a fluid has not been dispensed from said resilient squeeze bottle prior to a first use.

188. The automatic dispensing apparatus of claim 187 including means for coupling said automatic valve to said cap body;

or, aid automatic valve is integrally formed with said cap body;

or, said automatic valve is integrally molded with said cap body;

or, said automatic valve is bonded to said cap body;

or, said valve is coupled across one side only of said aperture in said cap wall;

or, said valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

189. The automatic dispensing apparatus of claim 187 wherein said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

190. The automatic dispensing apparatus of claim 187 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt; and cap fastening device is integrally formed on the inner surface of said inner skirt.

191. The automatic dispensing apparatus of claim 187 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

192. An automatic dispensing apparatus comprising:

a resilient squeeze bottle and an automatic dispensing cap;

said resilient squeeze bottle having squeeze bottle threads, a squeeze bottle neck, a squeeze bottle mouth, and, a squeeze bottle lip;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein;

said automatic dispensing cap is securely attached to said resilient squeeze bottle;

said automatic dispensing cap having a cap body;

said cap body having cap threads; said cap threads engage said squeeze bottle threads;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface;

said automatic dispensing cap having means for dispensing said food fluid with one hand when said resilient squeeze bottle is stored in said dispensing cap down position on said horizontal surface;

whereby said food fluid is dispensed with one hand by lifting and squeezing said resilient squeeze bottle with one hand.

193. The automatic dispensing apparatus of claim 192 including means for coupling said automatic valve to said cap body;

or, aid automatic valve is integrally formed with said cap body;

or, said automatic valve is integrally molded with said cap body;

or, said automatic valve is bonded to said cap body;

or, said valve is coupled across one side only of said aperture in said cap wall;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

194. The automatic dispensing apparatus of claim 192 said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

195. The automatic dispensing apparatus of claim 192 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt; and cap fastening device is integrally formed on the inner surface of said inner skirt.

196. The automatic dispensing apparatus of claim 192 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

197. A dispensing apparatus comprising:

a resilient squeeze bottle and a dispensing cap;

said resilient squeeze bottle having squeeze bottle threads; said squeeze bottle threads have a diameter of substantially 33 millimeters (substantially 1.31 inches); a squeeze bottle neck, a squeeze bottle mouth, and, a squeeze bottle lip;

said resilient squeeze bottle having a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, a liquid therein;

said dispensing cap is securely attached to said resilient squeeze bottle;

said dispensing cap having a cap body;

said cap body having cap threads; said cap threads have a diameter of substantially 33 millimeters (substantially 1.31 inches);

said cap threads engage said squeeze bottle threads;

said dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

said support base having a cross sectional area that is larger than the cross sectional area of the neck of said squeeze bottle; or, said support base having a cross sectional area that is larger than the largest cross sectional area of said squeeze bottle.

198. The dispensing apparatus of claim 197 wherein an automatic valve is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said automatic dispensing cap having automatic bi-directional dispensing features; said automatic dispensing cap has an automatic liquid or viscous fluid dispensing feature; and, an automatic air venting feature;

said dispensing cap having means for preventing said automatic valve from contacting said horizontal surface when said squeeze bottle is stored in said dispensing cap down position on said horizontal surface.

199. The dispensing apparatus of claim 198 wherein said dispensing cap has means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

200. The dispensing apparatus of claim 197 wherein an annular rim is integrally formed around a perimeter of said dispensing cap; and said rim contacts said horizontal surface when said squeeze bottle is being stored in said dispensing cap down position on said horizontal surface;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt; and cap threads are integrally formed on the inner surface of said inner skirt.

201. The dispensing apparatus of claim 197 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said dispensing cap has a lid that has an open position, and, a closed position;

or, said dispensing cap has a lid that is attachable and detachable;

or, said dispensing cap has a hinged lid;

or, said dispensing cap has an integrally molded hinged lid;

or, said dispensing cap has a lid that has an open position, and, a closed position; and, said dispensing cap supports said squeeze bottle in said dispensing cap down position when said lid is in said closed position; and, when said lid is in said open position;

or, said dispensing cap has a hinged lid that has an open position and a closed position; and said dispensing cap supports said squeeze bottle in said dispensing cap down position when said hinged lid is in said closed position; and, when said hinged lid is in said open position;

or, said dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said dispensing cap has a lid that rotates between a closed position and an open position.

202. The dispensing apparatus of claim 197 wherein said resilient squeeze bottle is made of a material that is translucent;

or, said resilient squeeze bottle is made of a material that is opaque;

or, said resilient squeeze bottle is made of a material that is colored.

203. The dispensing apparatus of claim 197 wherein said dispensing apparatus has a safety seal that provides evidence that a fluid has not been dispensed from said resilient squeeze bottle prior to a first use.

204. An automatic dispensing apparatus comprising:

a resilient squeeze bottle and an automatic dispensing cap;

said resilient squeeze bottle having squeeze bottle threads; said squeeze bottle threads have a diameter of substantially 33 millimeters (substantially 1.31 inches); a squeeze bottle neck, a squeeze bottle mouth, and, a squeeze bottle lip;

said resilient squeeze bottle having a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, a liquid therein, or, a viscous fluid therein;

said automatic dispensing cap is securely attached to said resilient squeeze bottle;

said automatic dispensing cap having a cap body;

said cap body having cap threads; said cap threads have a diameter of substantially 33 millimeters (substantially 1.31 inches); said cap threads engage said squeeze bottle threads;

said automatic dispensing cap having a portion that is utilized as a support base when said resilient squeeze bottle is stored in a dispensing cap down position on a horizontal surface;

said support base having a cross sectional area that is larger than the cross sectional area of the neck of said squeeze bottle; or, said support base having a cross sectional area that is larger than the largest cross sectional area of said squeeze bottle;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

205. The automatic dispensing apparatus of claim 204 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

206. The automatic dispensing apparatus of claim 204 wherein an annular rim is integrally formed around a perimeter of said dispensing cap; and said rim contacts said horizontal surface when said squeeze bottle is being stored in said dispensing cap down position on said horizontal surface;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt, and cap threads are is integrally formed on the inner surface of said inner skirt.

207. The automatic dispensing apparatus of claim 204 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

208. The automatic dispensing apparatus of claim 204 wherein said resilient squeeze bottle is made of a material that is translucent;

or, said resilient squeeze bottle is made of a material that is opaque;

or, said resilient squeeze bottle is made of a material that is colored;

or, wherein said automatic dispensing apparatus has a safety seal that provides evidence that a fluid has not been dispensed from said resilient squeeze bottle prior to a first use.

209. An automatic dispensing apparatus comprising:

a resilient squeeze bottle and an automatic dispensing cap;

said resilient squeeze bottle having squeeze bottle threads; said squeeze bottle threads have a diameter of substantially 33 millimeters (substantially 1.31 inches); a squeeze bottle neck, a squeeze bottle mouth, and, a squeeze bottle lip;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hair care product therein, a hand care product therein, or, a body care product therein, or, a sun screen product therein, or, a sun related product therein; or, a viscous fluid therein;

said automatic dispensing cap is securely attached to said resilient squeeze bottle;

said automatic dispensing cap having a cap body;

said cap body having cap threads; said cap threads have a diameter of substantially 33 millimeters (substantially 1.31 inches); said cap threads engage said squeeze bottle threads;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body;

said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface;

said automatic dispensing cap having means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

210. The automatic dispensing apparatus of claim 209 including means for coupling said automatic valve to said cap body;

or, aid automatic valve is integrally formed with said cap body;

or, said automatic valve is integrally molded with said cap body;

or, said automatic valve is bonded to said cap body;

or, said valve is coupled across one side only of said aperture in said cap wall;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

211. The automatic dispensing apparatus of claim 209 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt;

and cap threads are integrally formed on the inner surface of said inner skirt.

212. The automatic dispensing apparatus of claim 209 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

213. The automatic dispensing apparatus of claim 209 wherein said resilient squeeze bottle is made of a material that is translucent;

or, said resilient squeeze bottle is made of a material that is opaque;

or, said resilient squeeze bottle is made of a material that is colored;

or, wherein said automatic dispensing apparatus has a safety seal that provides evidence that a fluid has not been dispensed from said resilient squeeze bottle prior to a first use.

214. A dispensing apparatus comprising:

a resilient squeeze bottle and a dispensing cap;

said resilient squeeze bottle having squeeze bottle threads; said squeeze bottle threads having a diameter of substantially 38 millimeters (substantially 1.43 inches); a squeeze bottle neck, a squeeze bottle mouth, and, a squeeze bottle lip;

said resilient squeeze bottle having a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, a liquid therein, or, a viscous fluid therein;

said dispensing cap is securely attached to said resilient squeeze bottle;

said dispensing cap having a cap body;

said cap body having cap threads; said cap threads having a diameter of substantially 38 millimeters (substantially 1.43 inches); said cap threads engage said squeeze bottle threads;

said dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

said support base having a cross sectional area that is larger than the cross sectional area of the neck of said squeeze bottle; or, said support base having a cross sectional area that is larger than the largest cross sectional area of said squeeze bottle.

215. The dispensing apparatus of claim 214 wherein an automatic valve is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said automatic dispensing cap having automatic bi-directional dispensing features; said automatic dispensing cap has an automatic liquid or viscous fluid dispensing feature; and, an automatic air venting feature;

said dispensing cap having means for preventing said automatic valve from contacting said horizontal surface when said squeeze bottle is stored in said dispensing cap down position on said horizontal surface.

216. The dispensing apparatus of claim 215 wherein said dispensing cap has means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

217. The dispensing cap of claim 214 wherein an annular rim is integrally formed around a perimeter of said dispensing cap; and said rim contacts said horizontal surface when said squeeze bottle is being stored in said dispensing cap down position on said horizontal surface;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt, and cap threads are integrally formed on the inner surface of said inner skirt.

218. The dispensing apparatus of claim 214 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said dispensing cap has a lid that has an open position, and, a closed position;

or, said dispensing cap has a lid that is attachable and detachable;

or, said dispensing cap has a hinged lid;

or, said dispensing cap has an integrally molded hinged lid;

or, said dispensing cap has a lid that has an open position, and, a closed position; and, said dispensing cap supports said squeeze bottle in said dispensing cap down position when said lid is in said closed position; and, when said lid is in said open position;

or, said dispensing cap has a hinged lid that has an open position and a closed position; and said dispensing cap supports said squeeze bottle in said dispensing cap down position when said hinged lid is in said closed position; and, when said hinged lid is in said open position;

or, said dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said dispensing cap has a lid that rotates between a closed position and an open position.

219. The dispensing apparatus of claim 214 wherein said resilient squeeze bottle is made of a material that is translucent;

or, said resilient squeeze bottle is made of a material that is opaque;

or, said resilient squeeze bottle is made of a material that is colored.

220. The dispensing apparatus of claim 214 wherein said dispensing apparatus has a safety seal that provides evidence that a fluid has not been dispensed from said resilient squeeze bottle prior to a first use.

221. An automatic dispensing apparatus comprising:

a resilient squeeze bottle and an automatic dispensing cap;

said resilient squeeze bottle having squeeze bottle threads; said squeeze bottle threads having a diameter of substantially 38 millimeters (substantially 1.43 inches); a squeeze bottle neck, a squeeze bottle mouth, and, a squeeze bottle lip;

said resilient squeeze bottle having a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, a liquid therein, or, a viscous fluid therein;

said automatic dispensing cap is securely attached to said resilient squeeze bottle;

said automatic dispensing cap having a cap body;

said cap body having cap threads; said cap threads having a diameter of substantially 38 millimeters (substantially 1.43 inches); said cap threads engage said squeeze bottle threads;

said automatic dispensing cap having a portion that is utilized as a support base when said resilient squeeze bottle is stored in a dispensing cap down position on a horizontal surface;

said support base having a cross sectional area that is larger than the cross sectional area of the neck of said squeeze bottle; or, said support base having a cross sectional area that is larger than the largest cross sectional area of said squeeze bottle;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said valve is coupled across one side only of said aperture in said cap wall;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface.

222. The automatic dispensing apparatus of claim 221 including means for coupling said automatic valve to said cap body;

or, aid automatic valve is integrally formed with said cap body;

or, said automatic valve is integrally molded with said cap body;

or, said automatic valve is bonded to said cap body;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

223. The automatic dispensing apparatus of claim 221 wherein an annular rim is integrally formed around a perimeter of said dispensing cap; and said rim contacts said horizontal surface when said squeeze bottle is being stored in said dispensing cap down position on said horizontal surface;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt, and cap threads are integrally formed on the inner surface of said inner skirt.

224. The automatic dispensing apparatus of claim 221 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

225. The automatic dispensing apparatus of claim 221 wherein said resilient squeeze bottle is made of a material that is translucent;

or, said resilient squeeze bottle is made of a material that is opaque;

or, said resilient squeeze bottle is made of a material that is colored or, wherein said automatic dispensing apparatus has a safety seal that provides evidence that a fluid has not been dispensed from said resilient squeeze bottle prior to a first use.

226. An automatic dispensing apparatus comprising:

a resilient squeeze bottle and an automatic dispensing cap;

said resilient squeeze bottle having squeeze bottle threads; said squeeze bottle threads having a diameter of substantially 38 millimeters (substantially 1.43 inches); a squeeze bottle neck, a squeeze bottle mouth, and, a squeeze bottle lip;

said resilient squeeze bottle having a food product therein, or, a viscous food fluid therein, or mustard therein, or, catsup therein, or, honey therein, or, mayonnaise therein, or, an edible gel therein, or, an edible oil therein, or, an edible cream therein, or, or, shampoo therein, or, lotion therein, or, a gel therein, or, an oil therein, or, a cream therein, or, a hair care product therein, a hand care product therein, or, a body care product therein, or, a sun screen product therein, or, a sun related product therein; or, a viscous fluid therein;

said automatic dispensing cap is securely attached to said resilient squeeze bottle;

said automatic dispensing cap having a cap body;

said cap body having cap threads; said cap threads having a diameter of substantially 38 millimeters (substantially 1.43 inches); said cap threads engage said squeeze bottle threads;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

an automatic valve that is securely coupled to said cap body; said automatic valve is securely coupled across said aperture in said cap wall of said cap body;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said cap body and said automatic valve are coupled together; said cap body and said valve are a self-contained dispensing cap; said self-contained dispensing cap having a stand alone, unitary structure;

said dispensing cap having means for preventing said automatic valve from contacting said horizontal surface when said squeeze bottle is stored in said dispensing cap down position on said horizontal surface;

said automatic dispensing cap having means for dispensing said fluid with one hand when said resilient squeeze bottle is stored in said dispensing cap down position on said horizontal surface;

whereby said fluid is dispensed with one hand by lifting and squeezing said resilient squeeze bottle with one hand.

227. The automatic dispensing apparatus of claim 226 including means for coupling said automatic valve to said cap body;

or, aid automatic valve is integrally formed with said cap body;

or, said automatic valve is integrally molded with said cap body;

or, said automatic valve is bonded to said cap body;

or, said valve is coupled across one side only of said aperture in said cap wall;

or, said automatic valve is located entirely outside of said aperture in said cap wall;

or, a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said dispensing orifice has a dispensing slit; or, said dispensing orifice has the shape of straight incision bounded by transverse incisions; or, said orifice is in the form of a cross; or, said orifice is in the form of a crescent;

or, said automatic valve coupled across said support base side of said aperture in said cap wall;

or, said automatic valve integrally formed across said support base side of said aperture in said cap wall;

or, said automatic valve integrally bonded across said support base side of said aperture in said cap wall;

or, said automatic valve integrally molded across said support base side of said aperture in said cap wall;

or, said automatic dispensing cap has automatic bi-directional dispensing features; said automatic dispensing cap has an automatic liquid or viscous fluid dispensing feature; and, an automatic air venting feature;

or, the lip of said squeeze bottle has a lip inner diameter; and, said automatic valve has a valve diameter; and said valve diameter is smaller than said lip inner diameter of said squeeze bottle;

or, said dispensing cap has a spout; and said automatic valve is coupled to said spout;

or, said automatic valve is integrally formed to said spout;

or, said automatic valve is integrally molded to said spout;

or, said automatic valve is to bonded to said spout.

228. The automatic dispensing apparatus of claim 226 wherein an annular rim is integrally formed around a perimeter of said dispensing cap; and said rim contacts said horizontal surface when said squeeze bottle is being stored in said dispensing cap down position on said horizontal surface;

or, said support base has a cross sectional area that is larger than the cross sectional area of the neck of said squeeze bottle; or, said support base has a cross sectional area that is larger than the largest cross sectional area of said squeeze bottle;

or, said dispensing cap has substantially a continuous seal between said dispensing cap and said horizontal surface when said squeeze bottle is being stored in said dispensing cap down position on said horizontal surface;

or, said dispensing cap has a squeeze bottle end and a support base end; and said support base end of said dispensing cap has a larger cross sectional area than said squeeze bottle end of said dispensing cap;

or, said dispensing cap has substantially a frusto conical shape;

or, said support base has substantially a round shape;

or; said dispensing cap has an inner skirt and an outer skirt, and cap threads are integrally formed on the inner surface of said inner skirt.

229. The automatic dispensing apparatus of claim 226 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

230. The automatic dispensing apparatus of claim 226 wherein said squeeze bottle is made of a material that is translucent;

or, said squeeze bottle is made of a material that is opaque;

or, said squeeze bottle is made of a material that is colored;

or, wherein said automatic dispensing apparatus has a safety seal that provides evidence that a fluid has not been dispensed from said resilient squeeze bottle prior to a first use.

231. A one piece automatic dispensing cap for use with a resilient squeeze bottle; said squeeze bottle having a squeeze bottle fastening device, a squeeze bottle neck, a squeeze bottle mouth, and a squeeze bottle lip; said squeeze bottle lip having a squeeze bottle lip inner diameter; said one piece automatic dispensing cap comprising:

a cap body;

said cap body is made of a material that has substantially rigid properties;

said cap body having a cap fastening device; said cap fastening device having means for attaching said cap body to said resilient squeeze bottle;

said one piece automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

said one piece automatic dispensing cap having an automatic valve;

said automatic valve is integrally formed with said cap body;

said automatic valve covers across said aperture in said cap wall of said cap body;

said cap body and said automatic valve are made of two different materials;

said automatic valve is substantially a flexible, elastic, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

said automatic dispensing cap having automatic bi-directional dispensing features; said automatic dispensing cap having an automatic liquid, or, viscous fluid dispensing feature; and, an automatic air venting feature;

said one piece dispensing cap having means for preventing said automatic valve from contacting said horizontal surface when said resilient squeeze bottle is stored in said dispensing cap down position on said horizontal surface.

232. The one piece automatic dispensing cap of claim 231 wherein said automatic dispensing cap has means for dispensing a fluid with one hand when said resilient squeeze bottle is stored in said dispensing cap down position on said horizontal surface;

whereby said fluid is dispensed with one hand by lifting and squeezing said resilient squeeze bottle with one hand.

233. The one piece automatic dispensing cap of claim 231 wherein a portion of said automatic valve has a contour inward toward said squeeze bottle; or, said automatic valve has an end wall that has a concave shape; or, said automatic valve has an end wall that has a convex shape; or, said automatic valve has an end wall that has a domed shape; or, said automatic valve has an end wall that has a horizontal shape;

or, said automatic valve has a valve diameter; and said valve diameter is smaller than said squeeze bottle lip inner diameter;

or, said squeeze bottle is located away from said automatic valve when said squeeze bottle is attached to said one piece automatic dispensing cap;

or, said dispensing orifice has a dispensing slit; or, said dispensing orifice has the shape of straight incision bounded by transverse incisions; or, said orifice is in the form of a cross; or, said orifice is in the form of a crescent.

234. The one piece automatic dispensing cap of claim 231 wherein said automatic valve is integrally molded with said cap body.

235. The one piece automatic dispensing cap of claim 231 wherein said automatic valve covers across one side only of said aperture in said cap wall.

236. The one piece automatic dispensing cap of claim 231 wherein said automatic valve covers across said support base side only of said aperture in said cap wall.

237. The one piece automatic dispensing cap of claim 231 wherein said automatic valve is located entirely outside of said aperture in said cap wall.

238. The one piece automatic dispensing cap of claim 231 wherein said dispensing cap has a spout, and said automatic valve is integrally formed to said spout.

239. The one piece automatic dispensing cap of claim 231 wherein said cap fastening device is cap threads;

or, said cap fastening device is a cap snap fitting.

240. The one piece automatic dispensing cap of claim 231 wherein said dispensing cap has an inner skirt and an outer skirt; and, said cap fastening device is integrally formed on the inner surface of said inner skirt.

241. The one piece automatic dispensing cap of claim 231 wherein said dispensing cap has an inner skirt and an outer skirt; and, cap threads are integrally formed on the inner surface of said inner skirt.

242. The one piece automatic dispensing cap of claim 231 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

243. The one piece automatic dispensing cap of claim 231 wherein said support base has substantially a round shape;

or, or said support base has a long axis and a short axis.

244. The one piece automatic dispensing cap of claim 231 wherein an annular rim is integrally formed around a perimeter of said dispensing cap; and, said rim contacts said horizontal surface when said squeeze bottle is being stored in said dispensing cap down position on said horizontal surface;

or, said dispensing cap has substantially a continuous seal between said dispensing cap and said horizontal surface when said squeeze bottle is being stored in said dispensing cap down position on said horizontal surface.

245. The one piece automatic dispensing cap of claim 231 wherein said support base has a cross sectional area that is larger than the cross sectional area of the neck of said squeeze bottle;

or, said support base has a cross sectional area that is larger than the largest cross sectional area of said squeeze bottle.

246. The one piece automatic dispensing cap of claim 231 wherein said dispensing cap has a squeeze bottle end and a support base end; and, said support base end of said dispensing cap has a larger cross sectional area than said squeeze bottle end of said dispensing cap.

247. The one piece automatic dispensing cap of claim 231 wherein there is a fluid tight seal between the lip of said squeeze bottle, and, said automatic dispensing cap;

or, said automatic dispensing cap has an integrally formed annular sealing element; and, there is a fluid tight seal between said squeeze bottle and said integrally formed annular sealing element;

or, said automatic dispensing cap has a lid that has an open position, and, a closed position;

or, said automatic dispensing cap has a lid that is attachable and detachable;

or, said automatic dispensing cap has a hinged lid;

or, said automatic dispensing cap has an integrally molded hinged lid;

or, said automatic dispensing cap has a lid that has an open position, and, a closed position; and, said dispensing cap supports said squeeze bottle in said dispensing cap down position when said lid is in said closed position; and, when said lid is in said open position;

or, said automatic dispensing cap has a hinged lid that has an open position and a closed position; and said dispensing cap supports said squeeze bottle in said dispensing cap down position when said hinged lid is in said closed position; and, when said hinged lid is in said open position;

or, said automatic dispensing cap has an integrally molded hinged lid; and, said dispensing cap supports said squeeze bottle in said dispensing cap down position when said integrally molded hinged lid is in said closed position; and, when said integrally molded hinged lid is in said open position;

or, said automatic dispensing cap has a lid that rotates between a closed position and an open position.

248. The one piece automatic dispensing cap of claim 231 including a resilient squeeze bottle;

said resilient squeeze bottle having a squeeze bottle fastening device, a squeeze bottle neck, a squeeze bottle mouth, and, a squeeze bottle lip;

said resilient squeeze bottle having a liquid therein, or, a viscous fluid therein, or, a food product therein, or, a food liquid therein, or, a viscous food fluid therein, or mustard therein, or, catsup therein, or, honey therein, or, mayonnaise therein, or, an edible gel therein, or, an edible oil therein, or, an edible cream therein, or, shampoo therein, or, lotion therein, or, a gel therein, or, an oil therein, or, a cream therein, or, a hand care liquid product therein, or, a body care product therein, or, a sun screen product therein, or, a sun related product therein.

249. The automatic dispensing apparatus of claim 248 wherein said resilient squeeze bottle is made of a material that is translucent;

or, said resilient squeeze bottle is made of a material that is opaque;

or, said resilient squeeze bottle is made of a material that is colored.

250. The automatic dispensing apparatus of claim 249 wherein said dispensing apparatus has a safety seal that provides evidence that a fluid has not been dispensed from said resilient squeeze bottle prior to a first use.

251. A method of storing and dispensing a liquid or a viscous fluid utilizing an automatic dispensing apparatus comprising the steps of:

providing a resilient squeeze bottle; said resilient squeeze bottle having a squeeze bottle neck, a squeeze bottle mouth, a squeeze bottle lip, and, a squeeze bottle fastening device;

providing a liquid, or, a viscous fluid;

said liquid, or, said viscous fluid is a food product, or, a liquid food product, or, a viscous food fluid, or, mustard, or, catsup, or, honey, or, mayonnaise, or, an edible gel, or, an edible oil, or, an edible cream;

placing said liquid, or, said viscous fluid into said resilient squeeze bottle;

conceiving of a design for an automatic dispensing cap;

designing said automatic dispensing cap;

said automatic dispensing cap having a cap body;

said cap body having a cap fastening device; said cap fastening device having means for attaching said cap body to said resilient squeeze bottle;

said automatic dispensing cap having a portion that is utilized as a support base when said resilient squeeze bottle is stored in a dispensing cap down position on a horizontal surface;

said cap body having a cap wall; said cap wall having a squeeze bottle side and a support base side;

said cap wall having an aperture therethrough; said aperture having a squeeze bottle side and a support base side;

providing an automatic valve;

said cap body and said automatic valve are made of two distinct, different materials;

said automatic valve being substantially an elastic, flexible, single layer membrane that has a normally closed dispensing orifice therethrough;

said dispensing orifice automatically opens to permit fluid flow through said dispensing orifice in response to increased pressure on one side of said dispensing orifice;

said dispensing orifice automatically closes, cutting off fluid flow through said dispensing orifice when the increased pressure ends;

securely coupling said automatic valve to said cap body; said automatic valve is securely coupling across one side only of said aperture in said cap wall;

said cap body and said automatic valve are coupled together; said cap body and said valve are a self-contained dispensing cap; said self-contained dispensing cap having a stand alone, unitary structure;

said automatic dispensing cap having automatic bi-directional dispensing features; said automatic dispensing cap having an automatic liquid or viscous fluid dispensing feature; and, an automatic air venting feature;

said dispensing cap having means for preventing said automatic valve from contacting said horizontal surface when said squeeze bottle is stored in said dispensing cap down position on said horizontal surface;

said automatic dispensing cap having means for dispensing said fluid with one hand when said squeeze bottle is stored in said dispensing cap down position on said horizontal surface;

making said automatic dispensing cap;

providing said automatic dispensing cap;

attaching said automatic dispensing cap to said resilient squeeze bottle; said cap fastening device engages said squeeze bottle fastening device;

positioning said resilient squeeze bottle in said dispensing cap down position on a horizontal surface;

storing said resilient squeeze bottle in said dispensing cap down position on said horizontal surface until said liquid or said viscous fluid is positioned adjacent said automatic valve;

picking up said resilient squeeze bottle with one hand while said resilient squeeze bottle is stored in said dispensing cap down position on said horizontal surface;

and, squeezing said resilient squeeze bottle with one hand to dispense said liquid or said viscous fluid;

whereby said liquid or said viscous fluid is dispensed with one hand by lifting and squeezing said resilient squeeze bottle with one hand.

252. The method of claim 251 including means for coupling said automatic valve to said cap body; or said automatic valve is integrally formed with said cap body; or said automatic valve is integrally molded to said cap body; or said automatic valve is bonded to said cap body.

253. The method of claim 251 wherein said automatic valve covers across said support base side only of said aperture in said cap wall.

254. The method of claim 251 wherein said automatic valve is located entirely outside of said aperture in said cap wall.

255. The method of claim 251 wherein the lip of said squeeze bottle has a lip inner diameter and said automatic valve has a valve diameter; and said valve diameter is smaller than said lip inner diameter of said squeeze bottle.

256. The method of claim 251 wherein there is a fluid tight seal between the lip of said squeeze bottle and said automatic dispensing cap;

or, said automatic dispensing cap has an integrally formed annular sealing element; and there is a fluid tight seal between said squeeze bottle and said integrally formed annular sealing element.

257. The method of claim 251 wherein said dispensing cap has a spout, and said automatic valve is coupled to said spout; or said automatic valve is integrally formed to said spout; or said automatic valve is integrally molded to said spout; or and said automatic valve is bonded to said spout.

258. The method of claim 251 wherein an annular rim is integrally formed around a perimeter of said dispensing cap; and, said rim contacts said horizontal surface when said squeeze bottle is being stored in said dispensing cap down position on said horizontal surface.

259. The method of claim 251 wherein said support base has a cross sectional area that is larger than the cross sectional area of the neck of said squeeze bottle;

or, said support base has a cross sectional area that is larger than the largest cross sectional area of said squeeze bottle.

260. The method of claim 251 wherein said dispensing cap has substantially a continuous seal between said dispensing cap and said horizontal surface when said squeeze bottle is being stored in said dispensing cap down position on said horizontal surface.

261. The method of claim 251 wherein said dispensing cap has a squeeze bottle end and a support base end;

and, said support base end of said dispensing cap has a larger cross sectional area than said squeeze bottle end of said dispensing cap.

262. The method of claim 251 wherein said support base has substantially a round shape;

or, said squeeze bottle has a cross sectional shape that is substantially round.

263. The method of claim 251 wherein said dispensing cap has an inner skirt and an outer skirt; and, cap threads are integrally formed on the inner surface of said inner skirt.

264. The method of claim 251 wherein said cap fastening device is cap threads;

said cap threads have a diameter of substantially 24 millimeters (substantially 0.937 inches);

or, said cap threads have a diameter of substantially 28 millimeters (substantially 1.06 inches);

or, said cap threads have a diameter of substantially 33 millimeters (substantially 1.31 inches);

or, said cap threads have a diameter of substantially 38 millimeters (substantially 1.43 inches).

265. The method of claim 264 wherein said resilient squeeze bottle has a squeeze bottle top and a squeeze bottle bottom;

and, said squeeze bottle top has means for preventing said resilient squeeze bottle from being stored on said squeeze bottle top;

and, said automatic dispensing cap is securely fastened to said squeeze bottle bottom.

266. The method of claim 251 wherein said resilient squeeze bottle is made of a material that is translucent;

or, said resilient squeeze bottle is made of a material that is opaque;

or, said resilient squeeze bottle is made of a material that is colored.

* * * * *